US010214869B1

(12) United States Patent
Krajewski et al.

(10) Patent No.: US 10,214,869 B1
(45) Date of Patent: Feb. 26, 2019

(54) OUTDOOR POWER EQUIPMENT INCLUDING ELECTRIC WHEEL MOTORS AND CONTROLS

(71) Applicant: Briggs & Stratton Corporation, Wauwatosa, WI (US)

(72) Inventors: Christopher M. Krajewski, West Allis, WI (US); Todd William Johnson, Wauwatosa, WI (US); James Michael Busse, Kenosha, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 15/492,967

(22) Filed: Apr. 20, 2017

Related U.S. Application Data

(60) Provisional application No. 62/424,151, filed on Nov. 18, 2016, provisional application No. 62/328,865, filed on Apr. 28, 2016.

(51) Int. Cl.
*E01H 5/09* (2006.01)
*E01H 5/04* (2006.01)

(52) U.S. Cl.
CPC ..... *E01H 5/09* (2013.01); *E01H 5/045* (2013.01); *E01H 5/098* (2013.01)

(58) Field of Classification Search
CPC ..... E01H 5/09; E01H 5/045; E01H 5/098
See application file for complete search history.

(56) References Cited

U.S. PATENT DOCUMENTS 3,272,030 A * 9/1966 Blozis ..... E01H 5/04 180/19.1
5,018,592 A * 5/1991 Buchdrucker ..... B62D 11/08 180/19.3
5,297,379 A * 3/1994 Smith ..... A01D 34/68 180/19.1
5,648,708 A * 7/1997 Littlejohn ..... G01L 5/161 180/907
6,363,630 B1 * 4/2002 Ziegler ..... B60K 17/02 180/19.3
6,523,334 B1 * 2/2003 Dettmann ..... A01D 34/58 56/11.9
6,578,292 B2 * 6/2003 Dowe ..... E01H 5/04 37/257
6,798,160 B2 * 9/2004 Wakitani ..... B60L 3/0023 318/135
7,275,615 B2 * 10/2007 Derby ..... A01D 34/824 180/19.3

(Continued)

*Primary Examiner* — Jamie L McGowan
(74) *Attorney, Agent, or Firm* — Foley & Lardner LLP

(57) ABSTRACT

A snow thrower including an auger, a chute, a prime mover, and first and second drive wheels powered by the prime mover configured to be driven at variable speeds. The snow thrower further includes a user interface including a left hand grip and a right hand grip configured to pivot within an angular range of motion relative to an axis of rotation to indicate a direction and a magnitude of a desired turn, a steering sensor, and an electronic control unit configured to control operation of the first and second drive wheels. The user interface is pivoted in a first direction about the axis of rotation, the first and second bumpers are configured to contact the first and second force sensors to apply forces to the first and second force sensors to send first and second signals indicative of the forces to the electronic control unit.

20 Claims, 12 Drawing Sheets

(56) References Cited

U.S. PATENT DOCUMENTS

| | | | | |
|---|---|---|---|---|
| 7,523,795 | B2 * | 4/2009 | Velke | A01D 34/82 180/19.1 |
| 7,971,695 | B2 * | 7/2011 | Vaughn | B62D 11/08 192/13 R |
| 9,163,707 | B2 * | 10/2015 | Helin | A01D 34/6806 |
| 9,185,843 | B2 | 11/2015 | Kaskawitz et al. | |
| 9,403,435 | B2 | 8/2016 | Bejcek | |
| 9,470,305 | B2 | 10/2016 | Kaskawitz et al. | |
| 9,538,699 | B1 | 1/2017 | Bejcek et al. | |
| 9,545,054 | B2 | 1/2017 | Prinzo | |
| 9,643,705 | B2 * | 5/2017 | Steven | B63H 25/02 |
| 9,696,749 | B2 | 7/2017 | Kaskawitz et al. | |
| 2003/0000190 | A1 * | 1/2003 | Busboom | A01D 34/6806 56/10.8 |
| 2005/0039353 | A1 * | 2/2005 | Hanafusa | E01H 5/04 37/242 |
| 2007/0037668 | A1 * | 2/2007 | Cofrin | A63B 21/0618 482/51 |
| 2007/0289785 | A1 * | 12/2007 | Mayer | A01D 34/68 180/6.32 |
| 2010/0198469 | A1 * | 8/2010 | Mair | F16H 61/16 701/65 |
| 2016/0244925 | A1 * | 8/2016 | Yuki | E01H 5/045 |
| 2017/0142898 | A1 | 5/2017 | Bejcek et al. | |

* cited by examiner

OUTDOOR POWER EQUIPMENT INCLUDING ELECTRIC WHEEL MOTORS AND CONTROLS

CROSS-REFERENCE TO RELATED PATENT APPLICATIONS

This application claims the benefit of U.S. Application No. 62/328,865, filed Apr. 28, 2016, and U.S. Application No. 62/424,151, filed Nov. 18, 2016, both of which are incorporated herein by reference in their entireties.

BACKGROUND

The present invention relates generally to the field of outdoor power equipment. More specifically, the present invention relates to an electronic control system and drives for outdoor power equipment, including snow throwers.

SUMMARY

One embodiment of the invention relates to a snow thrower including an auger for gathering snow, a chute for discharging the gathered snow, a prime mover, a first drive wheel powered by the prime mover, and a second drive wheel powered by the prime mover. The first drive wheel and the second drive wheel are configured to be driven at variable speeds. The snow thrower further includes a user interface including a left hand grip and a right hand grip, where the user interface is configured to pivot within an angular range of motion relative to an axis of rotation to indicate a direction and a magnitude of a desired turn and a steering sensor including a first force sensor, a second force sensor, a first bumper positioned near the first force sensor, and a second bumper positioned near the second force sensor. The snow thrower further includes an electronic control unit configured to control operation of the first drive wheel and the second drive wheel. When the user interface is pivoted in a first direction about the axis of rotation, the first bumper is configured to contact the first force sensor to apply a first force to the first force sensor and the first force sensor is configured to send a first signal indicative of the first force to the electronic control unit. When the user interface is pivoted in a second direction about the axis of rotation, the second bumper is configured to contact the second force sensor to apply a second force to the second force sensor and the second force sensor is configured to send a second signal indicative of the second force to the electronic control unit. The electronic control unit is programmed to determine the direction and the magnitude of the desired turn in response to the first signal and the second signal and control the relative speeds of the first drive wheel and the second drive wheel to execute the desired turn.

Another embodiment of the invention relates to outdoor power equipment, including a prime mover, a first drive wheel powered by the prime mover, and a second drive wheel powered by the prime mover. The first drive wheel and the second drive wheel are configured to be driven at variable speeds. The outdoor power equipment further includes a user interface including a left hand grip and a right hand grip, where the user interface is configured to pivot within an angular range of motion relative to an axis of rotation to indicate a direction and a magnitude of a desired turn, a steering sensor including a first force sensor, a second force sensor, a first bumper positioned near the first force sensor, and a second bumper positioned near the second force sensor, and an electronic control unit configured to control operation of the first drive wheel and the second drive wheel. When the user interface is pivoted in a first direction about the axis of rotation, the first bumper is configured to contact the first force sensor to apply a first force to the first force sensor and the first force sensor is configured to send a first signal indicative of the first force to the electronic control unit. When the user interface is pivoted in a second direction about the axis of rotation, the second bumper is configured to contact the second force sensor to apply a second force to the second force sensor and the second force sensor is configured to send a second signal indicative of the second force to the electronic control unit. The electronic control unit is programmed to determine the direction and the magnitude of the desired turn in response to the first signal and the second signal, and control the relative speeds of the first drive wheel and the second drive wheel to execute the desired turn.

Another embodiment of the invention relates to a snow thrower including a first wheel, a first wheel motor configured to drive the first wheel, a second wheel, a second wheel motor configured to drive the second wheel, a user interface including a steering sensor configured to receive a user input indicating a direction and a magnitude of a desired turn, and an electronic control unit. The electronic control unit is configured to determine a snow thrower speed in response to a first wheel speed input from the first wheel motor and a second wheel speed input from the second wheel motor, receive the user input from the steering sensor indicating the direction and magnitude of the desired turn, compare the magnitude of the desired turn with a maximum allowable snow thrower speed for the desired turn, reduce the snow thrower speed to a reduced speed below the maximum allowable snow thrower speed for the desired turn, and control the first and second wheel motors to execute the desired turn.

Alternative exemplary embodiments relate to other features and combinations of features as may be generally recited in the claims.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring in general to FIGS. 1-5, a control system for outdoor power equipment is an electronic control system configured to simplify the use of outdoor power equipment. In particular, the control system is configured to simplify the use of a snow thrower. The hand controls, including controls for drive engagement, drive speed and direction control, auger or impeller engagement, chute rotation, and deflector position, are positioned such that they may be operated without releasing the hand grips. The system reduces the amount of human effort required and the complexity of operating a snow thrower. It also reduces the amount of time it takes the user to complete various snow throwing tasks. The electric wheel drive powered electrically through the control system for the snow thrower allows for reduction in noise and engine run time. In this regard, a user may move the snow thrower without starting the engine, which may allow for quiet transport and relatively higher fuel savings than conventional snow throwers.

Figure 1:
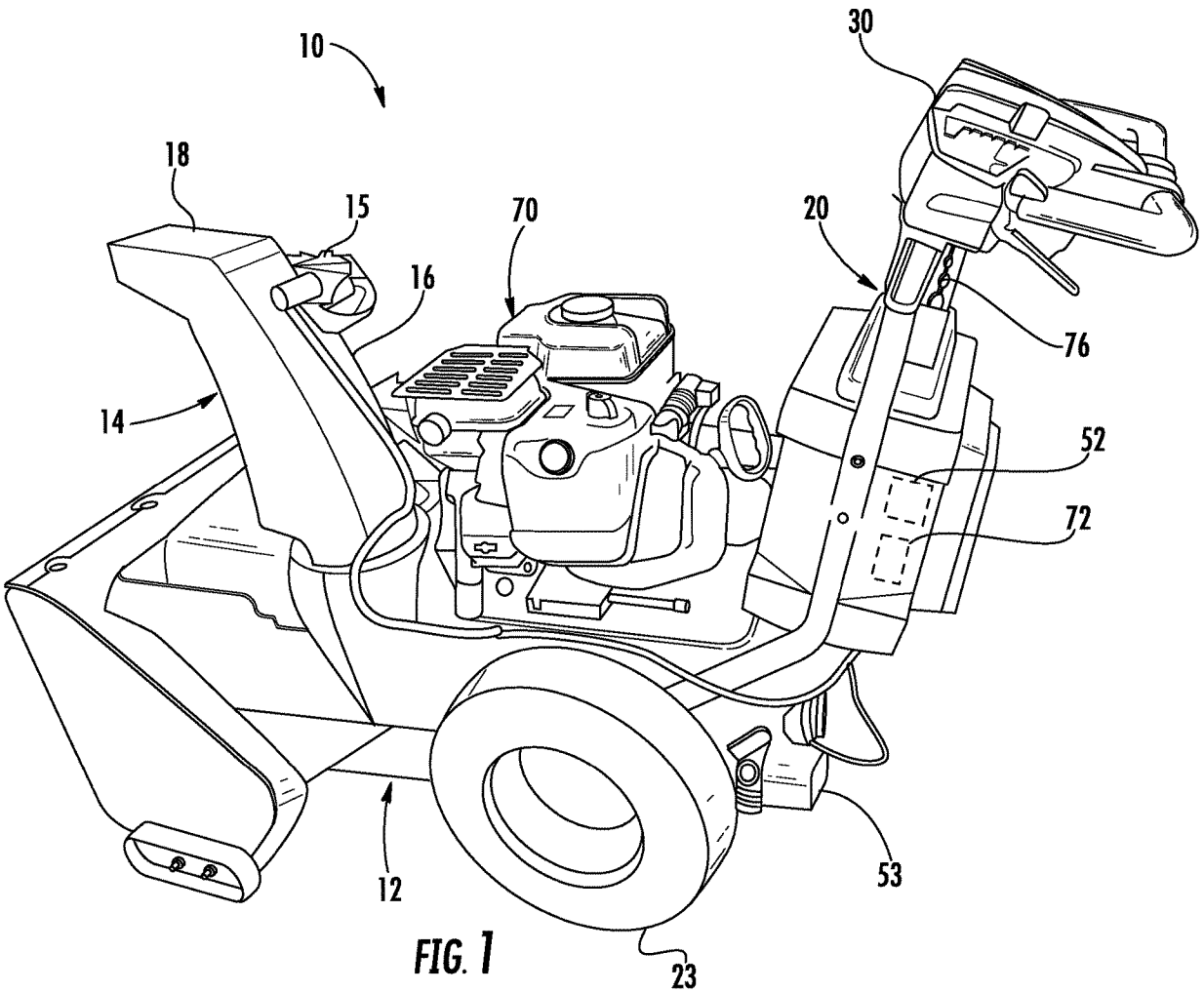
FIG. 1 is a perspective view of a snow thrower, according to an exemplary embodiment.
Figure 2A:
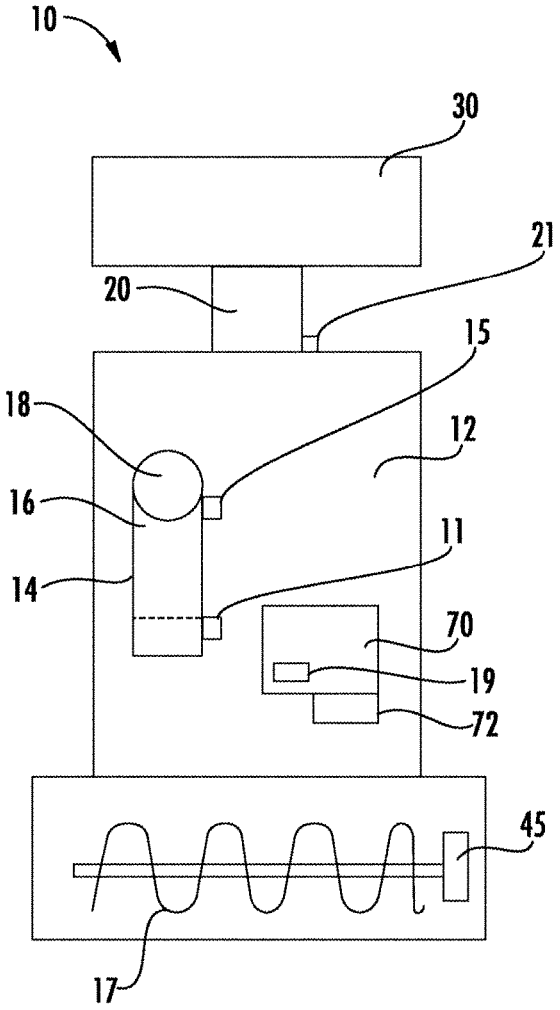
FIG. 2A is a front schematic view of the snow thrower of FIG. 1.
Figure 2B:
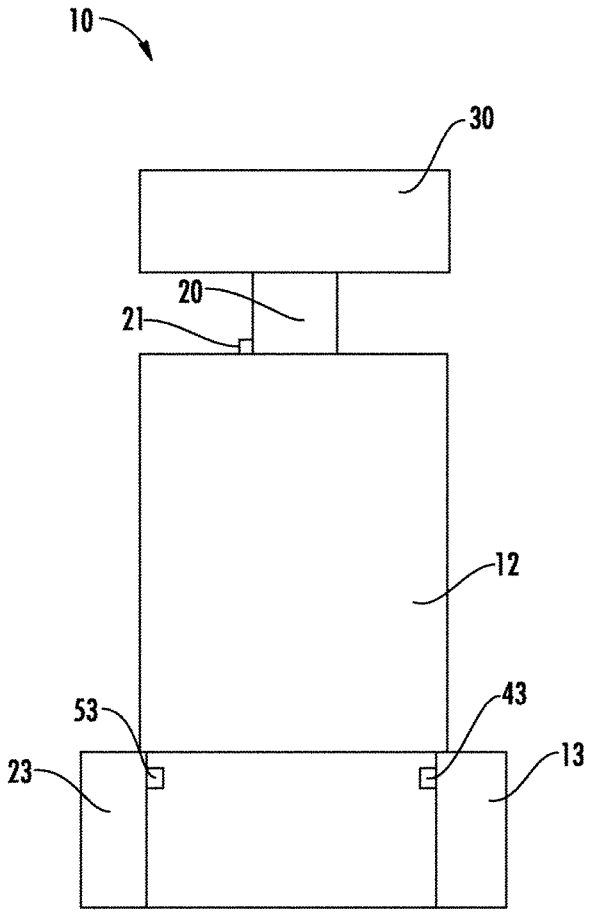
FIG. 2B is a back schematic view of the snow thrower of FIG. 1.

Referring to FIGS. 1-2B, a snow thrower 10 is illustrated. The snow thrower 10 includes a body 12, a chute 14 rotatable relative to the body 12, an auger 17, and a user interface 30 for controlling operation of various components of the snow thrower 10. The auger 17 acts to break up and gather snow toward the chute 14. The chute 14 discharges snow from the snow thrower 10 and includes a neck or main portion 16 rotatably coupled to the body 12 for rotation about a vertical axis. The chute 14 also includes a deflector 18 rotatably coupled to the neck 16 for rotation about a horizontal axis. Snow travels through the neck 16 and is discharged through the deflector 18. The direction of discharge is controlled by the position of the neck 16 relative to the body 12. The angle of discharge is controlled by the position of the deflector 18 relative to horizontal. The user interface 30 includes various controls for components of the snow thrower 10 and all controls may be operated by a user of the snow thrower 10 through the user interface 30, discussed further herein.

The snow thrower 10 further includes a deflector motor 15 structured to rotate the deflector 18 about a horizontal axis. The deflector motor 15 may be an electric motor electrically coupled to the user interface 30 such that the deflector 18 may be controlled by the user through the user interface 30. Additionally, the snow thrower 10 includes a neck motor 11 structured to rotate the neck 16 about a horizontal axis. The neck motor 11 may be an electric motor electrically coupled to the user interface 30 such that the neck 16 may be controlled by the user through the user interface 30. In some embodiments, the deflector 18 and neck 16 may be controlled manually by a user of the snow thrower 10.

Referring to FIG. 2A, the snow thrower 10 includes a centrifugal clutch 45 and an engine 70. The engine 70 may output mechanical power through a crankshaft of the engine 70 to the auger 17. The auger 17 may receive power from the engine 70 via the centrifugal clutch 45. The clutch 45 may be disengaged while the engine 70 is operating at a first or idle speed, so that auger 17 is inactive. When the engine 70 is at a second or operating speed, the clutch 45 is engaged, starting operation of the auger 17. The clutch 45 may be configured to engage/disengage at a predetermined speed between the engine idle and operating speed. The snow thrower 10 provides a fuel savings over a conventional system and for noise reduction through the use of an electric drive for the wheels when the auger 17 is disengaged and the engine is off or operating at idle speed.

Additionally, the snow thrower 10 includes an electronic governor 19. The electronic governor 19 serves to maintain the engine speed through varying loads on the engine 70. In use with the snow thrower 10, the electronic governor 19 may maintain the engine speed at a constant speed while the engine 70 of the snow thrower 10 is encountering various loads (e.g., varying depth of snow, varying weight of snow, varying consistency (e.g., wet, dry) of snow). Further, loading of the engine 70 of the snow thrower 10 may vary as a function of whether the auger 17 is actively engaged and discharging snow or is decoupled from the engine 70 (e.g., via clutch 45). A constant engine speed may be desirable in snow thrower operations to efficiently remove snow and to avoid potential problems, for example, snow clogging in the auger housing.

The snow thrower 10 may include one or more wheels each controlled by an electric wheel motor. In an exemplary embodiment, the snow thrower 10 may include a right wheel 13 and a left wheel 23. Additionally, the snow thrower 10 may include a right wheel motor 43 and a left wheel motor 53. Each electric wheel motor (e.g., right wheel motor 43, left wheel motor 53) may drive a respective wheel (e.g., right wheel 13, left wheel 23) in a forward or reverse direction. Each wheel may be electrically operated without starting the engine 70. The electric wheel motors 43 and 53 may receive power from a power source 72, such as a battery or an alternator driven by the engine 70. The power source 72 may be a removable, rechargeable battery (e.g., a lithium-ion battery, lead acid battery). The electric wheel motors 43 and 53 may be controlled through use of the user interface 30 and the electrical control unit, discussed further herein. The electric wheel motors 43 and 53 may allow a user to move the snow thrower 10 without starting the engine 70 and may provide fuel savings and noise reduction throughout the use of the snow thrower 10. As an example, the user may move the snow thrower 10 out of a garage or past already cleared ground without starting the engine 70. The snow thrower 10 may additionally provide a soft start feature through use of the electrical control unit to start the wheels in a smooth fashion. The soft start of the wheels may help to prevent bouncing of the auger housing while in operation. This may help to clear snow from the desired area more efficiently and in higher quantities. The soft start feature may vary from product to product, such that a rate of acceleration may differ between a snow thrower, a walk-behind mower, a ride mower, etc. The snow thrower 10 may further include a hard stop feature. The hard stop feature allows for an immediate stopping of the wheels 13, 23 of the snow thrower 10 when desired by the user. In the illustrated embodiment, the support column 20 includes a housing 74 that encloses the ECU 52 and the power source 72. The support column 20 also includes one or more user input devices 76 (e.g., buttons, switches, touch screens, etc.) to enable and disable various operating modes (e.g., traction control, speed sensitive steering, direct line control, cruise control, garage mode, transport mode, etc.).

In some embodiments, the snow thrower 10 may additionally include a steering sensor 21 configured to receive a user input that indicates the direction and size or magnitude of a turn (e.g., turning radius) that the user wishes to execute. As shown in FIGS. 1-2B, the steering sensor 21 may be located at or near the connection between the user interface 30 and the support column 20. In another embodiment, the steering sensor 21 may be located in the support column 20. The steering sensor 21 may include one or more torque, strain, and force sensors to detect a steering direction input (e.g., left, right) and a magnitude of the desired turn from the user interface 30. The steering sensor 21 may receive input from the user via the user interface 30 and may detect a magnitude and direction of a turn and thus, the wheels may turn the snow thrower 10. The steering sensor 21 communicates with the wheels to turn the snow thrower 10. The separate drive configuration of each wheel in conjunction with the steering sensor 21 may result in a larger range of motion and tighter turning radius of the snow thrower 10 as relative to conventional systems. Such input/output is facilitated by the electronic control unit, discussed further herein.

Figure 3A:
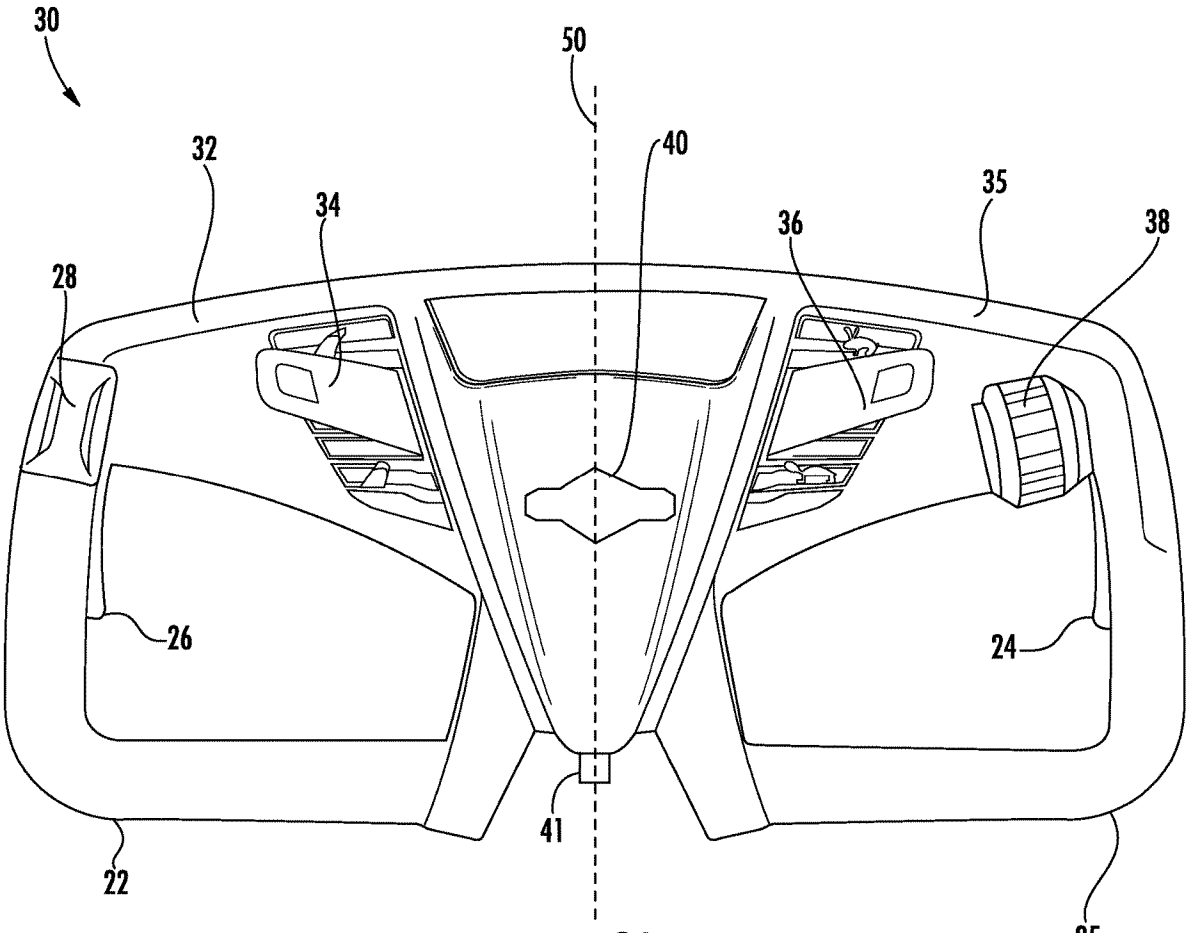
FIG. 3A is a top view of a user interface of the snow thrower of FIG. 1, according to an exemplary embodiment.
Figure 3B:
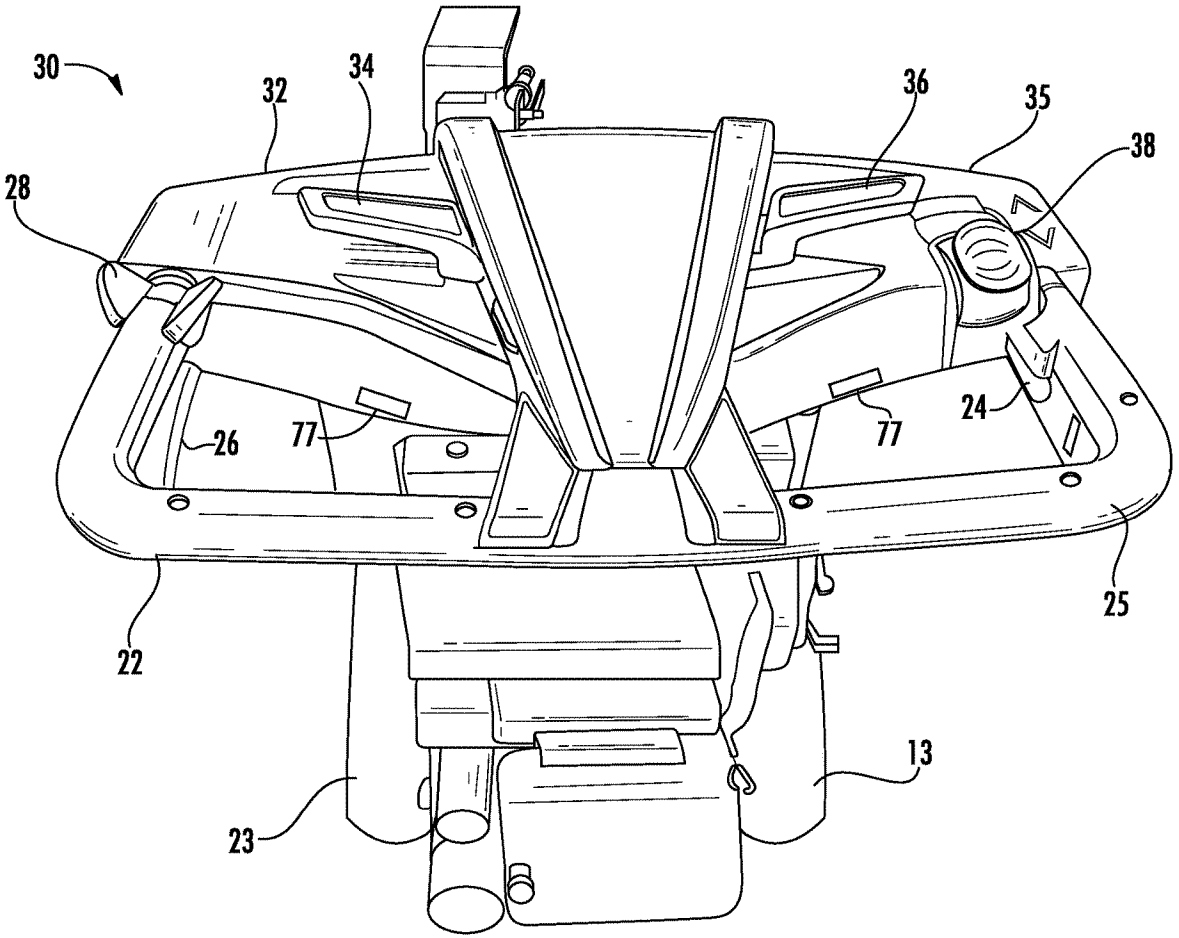
FIG. 3B is a perspective view of a user interface of the snow thrower of FIG. 1, according to an exemplary embodiment.

FIGS. 3A and 3B illustrate the snow thrower user interface 30 according to exemplary embodiments. The user interface 30 may include lower handle portions, designated as a left lower handle portion or left hand grip 22 and a right lower handle portion or right hand grip 25. Further, the user interface 30 may include upper handle portions, designated as a left upper handle portion 32 and a right upper handle portion 35. The left lower handle portion 22 and the left upper handle portion 32 may be located on the left side of vertical axis 50. The right lower handle portion 25 and right upper handle portion 35 may be located on the right side of vertical axis 50. The left lower handle portion 22 and the right lower handle portion 25 may be L-shaped and provide space for the user to grip the portions 22 and 25 to steer, push, pull, or otherwise physically maneuver the user interface 30 and thereby physically maneuver the snow thrower 10. In other embodiments, the lower handle portions may be any other shape such as to facilitate operation of the controls without removal of the hands of a user. In some other embodiments, the user interface 30 may include a single handle portion. In some embodiments, the user interface 30 may be a separate piece that can attach to the snow thrower 10 at the support column 20.

In addition to the handles, the user interface 30 includes a drive wheel input device 24 and an auger engagement input device 26 positioned near the lower handle portions (e.g., left lower handle portion 22 and right lower handle portion 25) of the user interface 30. The drive wheel input device 24 controls the drive wheel engagement of the snow thrower to start/stop movement of the snow thrower 10 and the auger engagement input device 26 controls the auger engagement of the snow thrower to start/stop the auger 17 to remove snow from the surface to be cleared. The auger engagement input device 26 and the drive wheel trigger 24 are positioned near the left lower handle portion 22 and the right lower handle portion 25, respectively, such that a user can depress the auger engagement input device 26 and the drive wheel input device 24 while retaining grasp on the handles. The auger engagement input device 26 and drive wheel input device 24 may be triggers. In other embodiments, the auger engagement input device 26 and drive wheel input device 24 may be controlled by levers, push buttons, touchpads, dials, buttons, switches, capacitive sensors, or any other appropriate devices for receiving input via the hand of the user. In other embodiments, other mechanisms may be utilized to detect the presence of the user's hands on the handles, such as accelerometers or pressure sensors. For example, with the engine 70 running, an accelerometer may be used to detect the change in vibration from the presence of the user's hands on the handles. An example of an accelerometer is a piezo film sensor, which may be housed in the grips of the handles to determine the presence of a user. The piezo film sensors are self-powered sensors configured to output a voltage that is proportional to their displacement. When a user grips the handles while the engine 70 is running, the output voltage is lowered. In this configuration, when a user grips the handles of the snow thrower 10, this may act as an auger engagement input device 26. In some embodiments, the auger 17 will remain engaged as long as one handle is held by the user. When a user releases the handles of the snow thrower 10, the piezo film sensors sense this due to the increase in vibration of the unit and disengage the auger 17.

Figure 4:
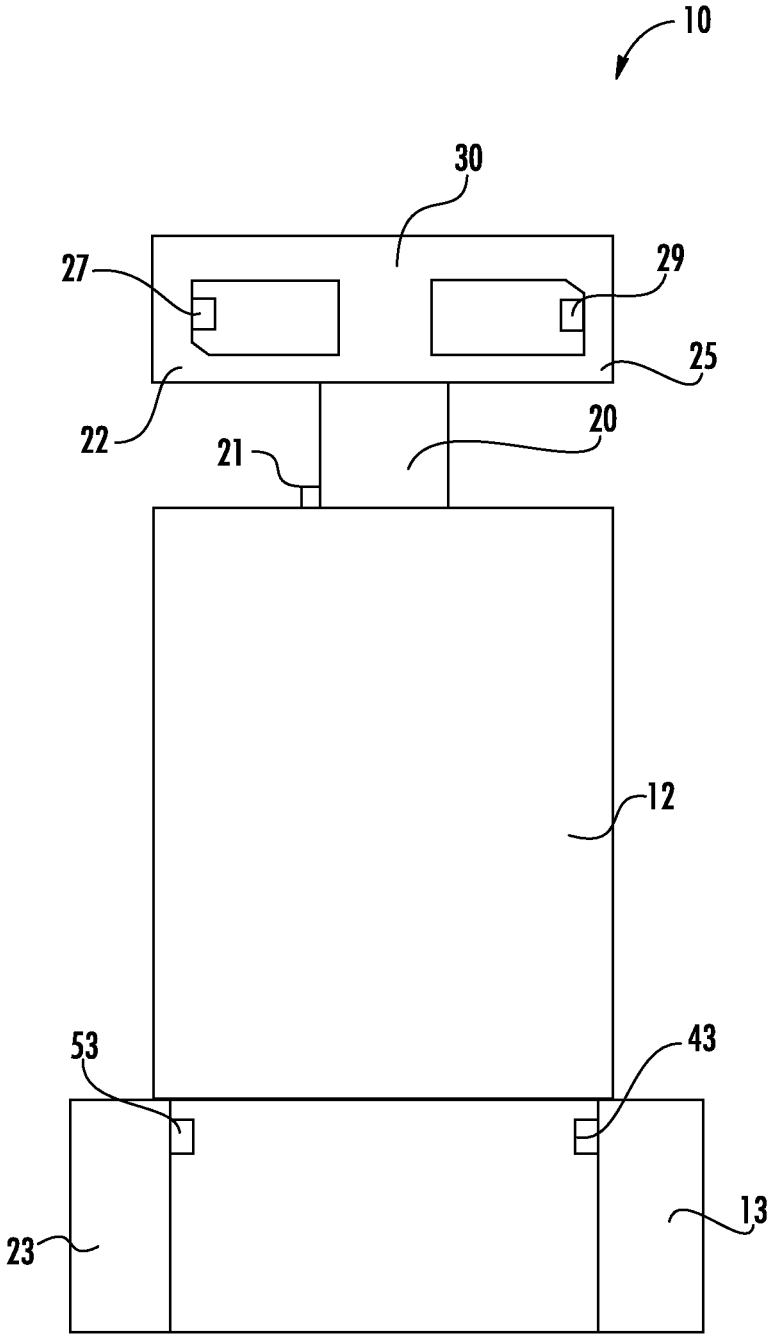
FIG. 4 is a back schematic view of the snow thrower of FIG. 1 with handle detail.
Figure 5:
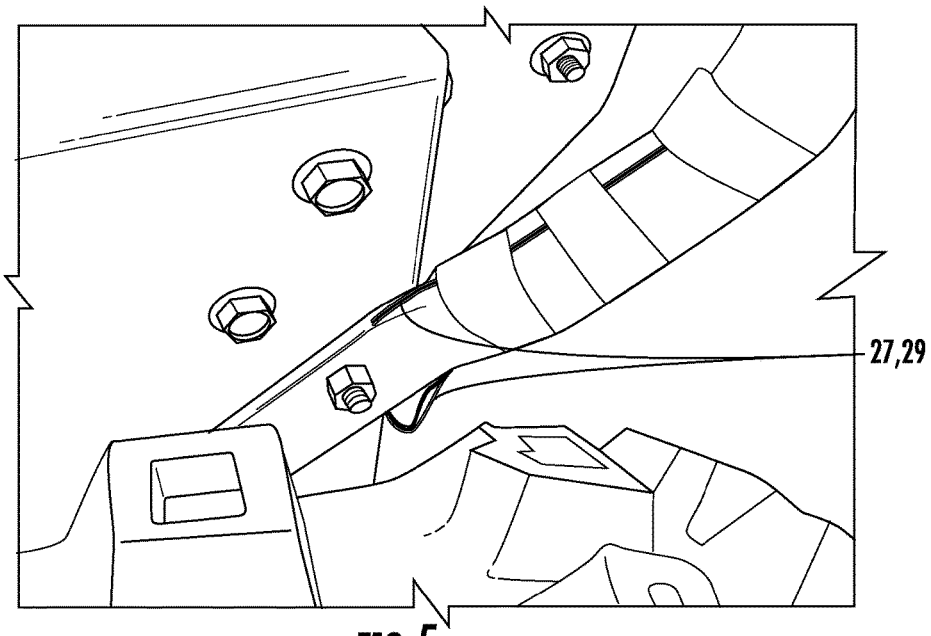
FIG. 5 is a perspective view of a strain gauge of the snow thrower of FIG. 1.
Figure 6:
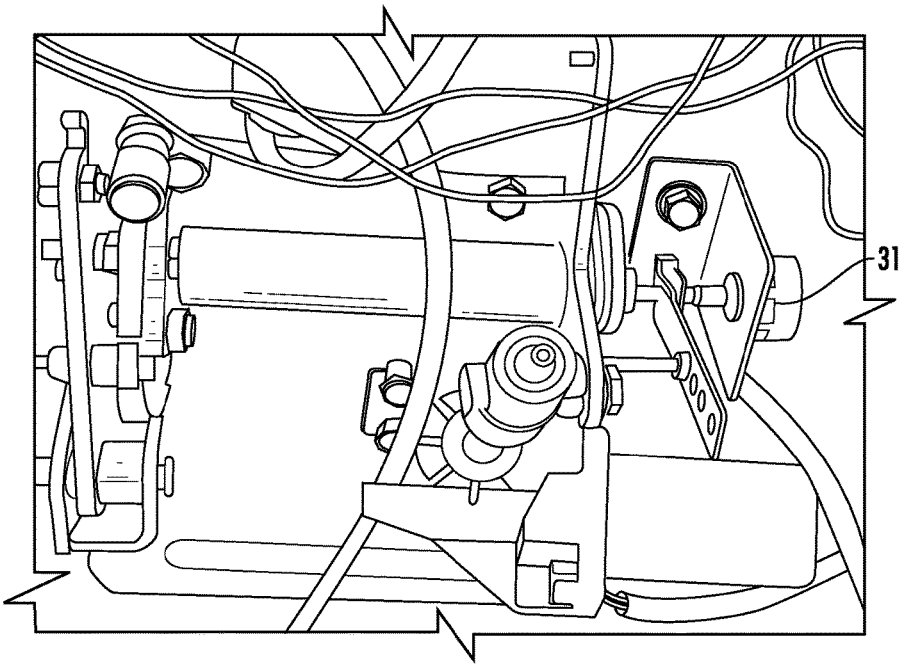
FIG. 6 is a perspective view of a potentiometer of the snow thrower of FIG. 1.

Referring now to FIG. 4, the back side of the snow thrower 10 is shown with further handle detail. As shown in the example embodiment, the snow thrower 10 the steering sensor 21 includes a left torque sensor or strain gauge 27 and a right torque sensor or strain gauge 29. The strain gauges may operate to sense the pressure or force applied to the user interface 30 by the user, such that the left strain gauge 27 senses a slight movement of left lower handle portion 22 relative to the support column 20 and the right strain gauge 29 senses the movement of right lower handle portion 25 relative to the support column 20. The user interface 30 pivots as a unit, such that when one handle portion is moved, the other handle portion moves as well. The strain gauges 27, 29 described herein sense the relative movement (e.g., push, pull, rotation) of the left and right lower handle portions 22, 25. When the user interface 30 is pushed in the forward direction, positive strain is produced and the snow thrower 10 may move forward, with the speed of the snow thrower 10 changing relative to how the strain in each strain gauge changes. For example, if the strain on the strain gauges increases, the speed of the snow thrower 10 will increase and if the strain on the strain gauges decreases, the speed of the snow thrower 10 will decrease. The strain gauges are configured such that a user may pace the snow thrower 10 to his personal pace. As a user moves forward at a certain speed, the strain gauges 27, 29 of the snow thrower 10 will sense the slight movements of the handle portions and will change the speed of the snow thrower 10 relative to how the strain in the strain gauges change. Similarly, if both handle portions are pulled in the reverse direction, negative strain is produced and the snow thrower 10 may move backward. As mentioned in further detail herein, a difference in the sensed strain between the left and right strain gauges will cause the snow thrower 10 to turn. In other embodiments, rather than a handle having two legs (e.g., left lower handle portion 22 and right lower handle portion 25), the handle may include a single leg, stem, or support. For handles using only a single stem, two strain bridges are used—one to measure bending of the stem and providing a speed and direction input and one to measure torsion to provide a steering input. For example, a first strain gauge is arranged vertically along the longitudinal axis of the stem to measure bending of the stem and provides the speed and direction input (e.g., more bending in the forward direction calls for increased speed in the forward direction, bending in the backward direction reverses for movement in the rearward direction, etc.) A second strain gauge is arranged horizontally relative to the longitudinal axis of the stem to measure torsion of the stem and provide the steering direction input (e.g., detecting torsion to the left would steer the unit left and detecting torsion to the right would steer the unit to the right).

Referring now to FIGS. 3A-6, the strain gauges are coupled to a potentiometer 31 positioned on or near the drive wheel input device 26. The potentiometer 31 is referenced to the potential voltage from the strain signal produced by the strain gauges. The potentiometer 31 is coupled to the drive wheel input device 26, such that a strain-speed control loop is created and the above-mentioned movement of the snow thrower 10 may occur. There may be amplification of the strain signal from the strain gauges such that the effort required to move the snow thrower 10 may be minimal on the part of the user.

Additionally, the left strain gauge 27 is coupled to the left wheel motor 43 and the right strain gauge 29 is coupled to the right wheel motor 53 (e.g., directly or via the electrical control unit), such that the movement of each of the handle portions may result in movement of each of the respective wheels (e.g., left wheel 23, right wheel 13). In some embodiments, this configuration may be used to turn the snow thrower 10. As an example, when a user pulls on a left lower handle portion 22 and pushes on a right lower handle portion 25, a negative strain is produced in the left strain gauge 27 and a positive strain is produced in the right strain gauge 29, such that the right wheel 13 will be locked and the left wheel 23 will be unlocked to facilitate a turn of the snow thrower 10 to the left. The snow thrower 10 may turn to the right in a similar fashion.

In some embodiments, the user interface 30 and steering systems described herein are used with a snow thrower using an engine or using a single motor to power both of the drive wheels (e.g., via one or transmissions). In these embodiments, a clutch is provided for each wheel to connect and disconnect the wheel to a transmission drive shaft. To turn the snow thrower 10, one of the clutches is disengaged from the drive shaft. The ECU 52 can control operation of the wheel clutches in response to steering inputs provided by the user interface 30 to cause the drive wheels to execute turns to the left or right. For example, when the left lower handle portion 22 is pulled, the strain gauges 27, 29 sense the left turn and a clutch (e.g., slip differential) at the left wheel disengages so that the left wheel 23 freewheels and moves slower than the right wheel 13, thereby implementing a turn to the left. As such, in some embodiments, when the right lower handle portion 25 is pulled, the strain gauges 27, 29 sense the right turn and a clutch at the right wheel disengages so that the right wheel 13 freewheels and moves slower than the left wheel 23, thereby implementing a turn to the right. In some embodiments, a motor or engine is used to power a pair of hydrostatic transmission, with one hydrostatic transmission provided for each of the two drive wheels. Each hydrostatic transmission can drive the associated wheel in forward or reverse at varying wheel speeds and can be placed in a neutral position in which the drive wheel is allowed to freewheel. The ECU 52 can control operation of the hydrostatic transmission in response to steering inputs provided by the user interface 30 to cause the drive wheels to execute turns to the left or right (e.g., by allowing one drive wheel to free as described above, by operating the drive wheels in opposite directions).

The strain gauges of the snow thrower 10 also facilitate the slow movement of the snow thrower 10 over an uneven surface. For example, when a user encounters an uneven surface, the user may push sharply down on the handle portions to clear the surface and in this case, a high-sloped negative strain is produced in the strain gauges. The snow thrower 10 may be configured such that this high-sloped negative strain may result in the wheel motors (e.g., left wheel motor 53, right wheel motor 43) moving the wheels (e.g., left wheel 23, right wheel 13) slowly in the forward direction instead of moving in the reverse direction. Thus, the use of strain gauges may result in a more intuitive operation of the snow thrower 10.

Further, referring to FIGS. 1-6, the auger engagement input device 26 may provide an input to start the engine 70 or to increase the engine speed. When the auger engagement input device 26 is depressed while the engine 70 is off, the engine 70 is started, the engine speed is increased to at least a predetermined speed (e.g., a speed between the idle speed of the engine 70 and an operating speed of the engine 70), at which point the threshold of the clutch 45 is exceeded and the auger 17 is active. When the engine 70 is already in operation, the auger engagement input device 26 may increase the speed of the engine 70 to exceed the predetermined speed. The input from the auger engagement input device 26 may signal to the electronic governor 19 to increase the speed of the engine 70 to at least the predetermined engine speed. The electronic governor 19 may change a throttle position of the engine 70 and thus, change the output speed of the engine 70. In another embodiment, the auger engagement input device 26 may provide input controlled through an electrical control unit to start the engine 70.

The engine 70 may be structured to power only the auger 17 and may remain off while the wheels (e.g., wheels 13 and 23) of the snow thrower 10 are electrically driven via the motors (e.g., motors 43 and 53). Loading of the engine 70 of the snow thrower 10 may vary as a function of whether the auger 17 is actively engaged and discharging snow or is decoupled from the engine 70 (e.g., via a clutch). Accordingly, the snow thrower 10 provides a fuel savings over a conventional system and for noise reduction allowing for the engine 70 to be in an idle-down mode when the auger 17 is disengaged. As an example, a user may easily talk to a neighbor while the auger 17 is disengaged and the engine 70 is idling or off because of noise reduction over conventional snow throwers. In some embodiments, once the auger engagement input device 26 has engaged the auger 17 by starting the engine 70 and increasing the engine speed to at least the predetermined speed, the trigger may be released without disengaging the auger 17. In some embodiments, the drive wheel input device 24 may need to be depressed while the wheels 13 and 23 of the snow thrower 10 are moving. In this case, release of the drive wheel trigger 24 causes the wheels to stop moving.

The user interface 30 may further include one or more input devices or controls used to operate the snow thrower 10. Such controls may include a speed/direction control, shown as a speed input device, throttle control, or speed wheel 38, a chute direction/angle control, shown as a chute position input device or rotator 28, a deflector direction/angle control, shown as a deflector position input device or adjustor 34, and a maximum speed input device or adjustor 36. The user interface 30 includes positioning of controls based on frequency of use and priority of user such that a lower priority or less frequently used control (e.g., deflector adjustor 34, maximum speed adjustor 36) may be positioned such that the user needs to remove a hand to adjust the control. If a control is higher priority or more frequently used (e.g., drive wheel trigger 24, auger engagement input device 26), the control may be positioned such that the user does not need to remove a hand to adjust the control. The user interface 30 is configured such that the user can use the majority of controls without removing a hand from the user interface 30.

According to an exemplary embodiment, the speed wheel 38 may be positioned near the right upper handle portion 35 such that a right thumb of the user may control the speed wheel 38 while gripping the right lower handle portion 25. The speed and direction (e.g., forward and reverse) of the snow thrower may be controlled by the speed wheel 38. In other embodiments, the speed wheel 38 may be positioned near the right lower handle portion 25. In another embodiment, the controls may be otherwise placed, such as on the surface of the handles or integrated into the handles. In some embodiments, the speed wheel 38 is biased to a neutral position in which the drive wheels do not move. If the speed wheel 38 is pressed in the upward or forward direction, the speed of the snow thrower 10 may be increased in the forward direction. If the speed wheel 38 is pressed in the downward or rearward direction with the snow thrower 10 moving forward, the direction of the snow thrower 10 is reversed and the speed of the snow thrower 10 may be increased in the reverse direction. There may not be a catch or stop between the forward and reverse directions such that moving from a forward direction to a reverse direction is fluid in nature. Thus, the snow thrower 10 may move directly either from a reverse direction to a forward direction or from a forward direction to a reverse direction without pausing in neutral. The user is able to control the speed and direction of the snow thrower 10 via the speed wheel 38 while keeping both hands on the user interface 30. The user is therefore able to both steer (via the user interface 30) and control the speed of the snow thrower 10 (via the speed wheel 38) while keeping both hands on the user interface 30.

According to an exemplary embodiment, the chute rotator 28 may be positioned near the left upper handle portion 32 such that a left thumb of the user may control the chute rotator 28 while gripping the left lower handle portion 22. In other embodiments, the chute rotator 28 may be positioned near the left lower handle portion 22. In another embodiment, the controls may be otherwise placed, such as on the surface of the handles or integrated into the handles. The position of the chute 14 may be controlled by the chute rotator 28 via the neck motor 11. If the chute rotator 28 is held to the left, the chute 14 may rotate to the left relative to the snow thrower body 12. If the chute rotator 28 is held to the right, the chute 14 may rotate to the right relative to the snow thrower body 12.

In some embodiments, the speed of the chute 14 rotation may be variable based on input from the chute rotator 28. Accordingly, the amount that a user moves the chute rotator 28 controls the speed of the rotation of the chute 14. For example, if a user moves the chute rotator 28 fully to the left, the chute 14 may rotate to the left at a higher speed than if the user moves the chute rotator 28 partially (e.g., halfway) to the left. Beneficially, the user can adjust the rotation speed of the chute 14 based on the speed of the snow thrower 10. For example, if the snow thrower 10 is moving at a relatively high speed, the user may desire to rotate the chute 14 at a high speed to account for the relatively quick change in position of the snow thrower 10.

The user interface 30 may further include a deflector adjustor 34. According to an exemplary embodiment, the deflector adjustor 34 may be positioned on the left upper handle portion 32 of the user interface 30. In other embodiments, the deflector adjustor 34 may be located elsewhere on the user interface 30. Operation of the deflector adjustor 34 may require that the user remove a hand from the handles of the user interface 30 to adjust the lever of the deflector adjustor 34. In other embodiments, the operation of the deflector adjustor 34 does not require that the user remove a hand from the handles of the user interface 30. The angle of the deflector 18 may be controlled by the deflector adjustor 34 via the deflector motor 15. If the deflector adjustor 34 is moved upward, the deflector 18 may move upward. If the deflector adjustor 34 is moved downward, the deflector 18 may move downward. In other embodiments, the angle and direction of the chute 14 and deflector 18 may be controlled with another device, such as individual joysticks for adjusting the horizontal and vertical angles, individual rocker switches for adjusting the horizontal and vertical angles, individual push buttons for adjusting the horizontal and vertical angles, one or more directional pads, touchpads, dials, buttons, switches, or other suitable devices.

The maximum speed setting of the wheels of the snow thrower may be controlled by the maximum speed adjustor 36. According to an exemplary embodiment, the maximum speed adjustor 36 may be positioned on the right upper handle portion 35 of the user interface 30. In other embodiments, the maximum speed adjustor 36 may be located elsewhere on the user interface 30. Operation of the maximum speed adjustor 36 may require that the user remove a hand from the handles of the user interface 30 to adjust the lever of the maximum speed adjustor 36. In other embodiments, the operation of the maximum speed adjustor 36 does not require that the user remove a hand from the handles of the user interface 30. If the maximum speed adjustor 36 is moved upward, the maximum speed may be higher and if the maximum speed adjustor 36 is moved downward, the maximum speed may be lower. Thus, if the speed wheel 38 is pressed upward or forward to its furthest position, the maximum speed that the snow thrower 10 can move in the forward direction may be determined by the setting of the maximum speed adjustor 36. If the speed wheel 38 is pressed downward or rearward, the maximum speed that the snow thrower 10 can move in the reverse direction may be determined by the setting of the maximum speed adjustor 36. In other embodiments, the speed and direction of the snow thrower 10 may be controlled with another device, such as individual buttons for the forward direction and the reverse direction, a dial, wheel, touchpad, or other suitable device. In some embodiments, the maximum speed adjustor 36 is infinitely variable between the minimum speed provided by the drive wheels and the maximum speed provided by the drive wheels. In other embodiments, the maximum speed adjustor 36 includes a number of speed increments, each associated with a particular speed.

An ignition switch 40 is provided on the user interface 30 to allow the user to start the prime mover (e.g., electric motor, internal combustion engine, diesel engine, etc.) of the snow thrower 10. According to an exemplary embodiment, the ignition switch 40 is a push button. In other embodiments, the ignition switch may also be another device, such as a key switch, capacitive sensor(s), etc. A removable key 41 may be added to the user interface 30 provide a two-step start system, wherein if the key 41 is removed, the ignition switch 40 will not start the prime mover of the snow thrower 10. Once the key 41 is replaced, the ignition switch 40 may start the prime mover. In other embodiments, different actuators or devices may be used to provide the second step on the two-step starting system. The two-step starting system may provide a safety feature for users concerned about unauthorized or unsupervised use of the snow thrower 10 (e.g., by children).

Additionally, the user interface 30 may be adjustable by the user. The snow thrower 10 may include a support column 20 between the body 12 and the user interface 30 structured to adjust the user interface 30 telescopically to allow for varying heights and sizes of users. Accordingly, the user may adjust the height of the user interface 30. A user may additionally adjust the tilt of the user interface 30 for varying angles of operation.

Figure 7:
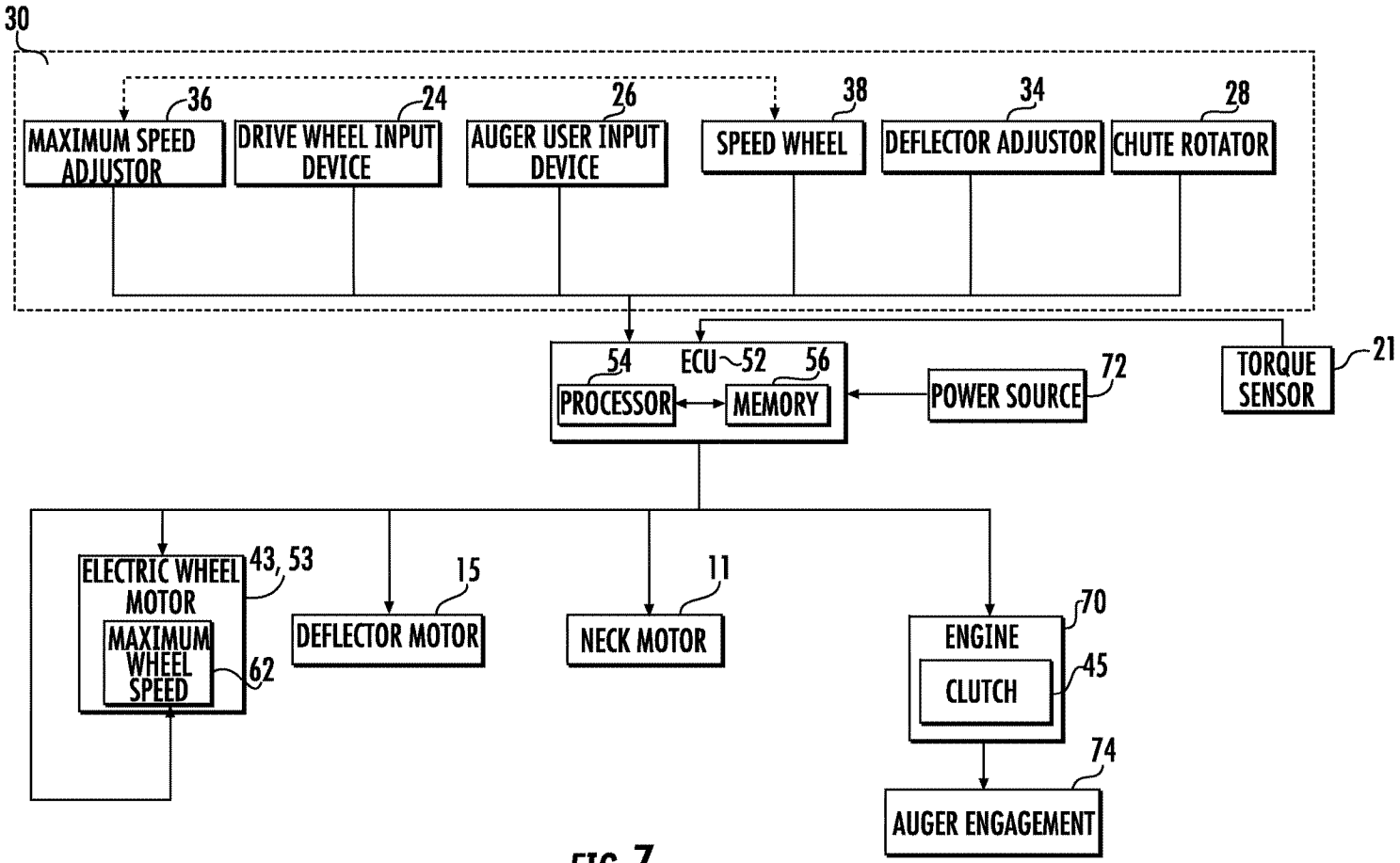
FIG. 7 is a block diagram of a control system of the snow thrower of FIG. 1.

Referring now to FIG. 7, the snow thrower 10 is controlled by a controller or an electrical control unit (ECU) 52 in response to inputs from the user interface 30 and other components of the snow thrower 10. The ECU 52 may include a processor 54 and a memory 56. The processor 54 may be implemented as a general purpose processor, an application specific integrated circuit (ASIC), one or more field programmable gate arrays (FPGAs), a group of processing components, or other suitable electronic processing components. The memory device 56 (e.g., memory, memory unit, storage device, etc.) is one or more devices (e.g., RAM, ROM, Flash memory, hard disk storage, etc.) for storing data and/or computer code for completing or facilitating the various processes, layers and modules described in the present application. The memory device 56 may be or include volatile memory or non-volatile memory. The memory device 56 may include database components, object code components, script components, or any other type of information structure for supporting the various activities and information structures described in the present application. According to an exemplary embodiment, the memory device 56 is communicably connected to the processor 54 and includes computer code for executing (e.g., by processing circuit and/or processor) one or more processes described herein.

The ECU 52 may receive user input from controls on the user interface 30, including the maximum speed adjustor 36, drive wheel input device 24, auger engagement input device 26, speed wheel 38, deflector adjustor 34, chute rotator 28, and steering sensor 21 and sends control signals to the respective motors. When the user sets the maximum speed adjustor 36 to a desired level, the maximum wheel speed 62 may be set. The maximum speed adjustor 36 and the speed wheel 38 may be coupled such that if the maximum wheel speed 62 is set, when the user moves the speed wheel 38, the snow thrower wheels will not exceed that maximum speed. This maximum speed may be applied in both forward and reverse directions of the snow thrower. The drive wheel input device 24 may electrically engage each electric wheel motor (e.g., motors 43 and 53) at each wheel (e.g., wheels 13 and 23) of the snow thrower, while the speed wheel 38 controls the speed of each wheel.

The steering sensor 21 provides an input to the ECU 52 for the direction and magnitude of turn of the wheels of the snow thrower. The output from the ECU 52 from the steering sensor 21 depends on the movement of the user interface 30 from the user. In an exemplary embodiment, if the user turns the user interface 30 to the right, the wheels (e.g., wheels 13 and 23) may turn to the right and if the user turns the user interface 30 to the left, the wheels may turn to the left. Each wheel may be controlled separately through respective wheel motors to accomplish a tight turning radius (e.g., a zero turn radius of the snow thrower). Accordingly, the steering sensor 21 may sense an input from the user of the magnitude of the turn. The steering sensor 21 may communicate via the ECU 52 to each of the wheel motors to operate one wheel at a higher speed than the other wheel (and at varying degrees of speed relative to each other). Thus, the snow thrower may turn at varying magnitudes depending on the input from the user.

In some embodiments, when moving in reverse, the snow thrower 10 may include reverse turning such that when a user turns the user interface 30 to the left (e.g., counter clockwise) when moving in reverse, the ECU 52 outputs a signal to operate the left wheel 23 at a higher speed than the right wheel 13, resulting in a counter clockwise turn of the snow thrower 10. Further, when a user turns the user interface 30 to the right (e.g., clockwise) when moving in reverse, the ECU 52 outputs a signal to operate the right wheel 13 at a higher speed than the left wheel 23, resulting in a clockwise turn of the snow thrower 10.

The deflector adjustor 34 and the chute rotator 28 may electrically operate the deflector motor 15 and the neck motor 11, respectively. The electrical control of the deflector and chute allows a user to adjust these features without letting go of the handles of the user interface 30. Further, the auger engagement input device 26 may start the engine 70, increase the engine speed to at least a predetermined speed, at which point the clutch 45 threshold is exceeded and auger engagement occurs.

The motors used in connection with the ECU 52 (e.g., right wheel motor 43, left wheel motor 53, deflector motor 15, neck motor 11) may receive power from a power source 72. The power source 72 may be an on-board power source, such as a battery or an alternator driven by the prime mover. The power source 72 may be a removable, rechargeable battery (e.g., a lithium-ion battery, lead acid battery).

In some embodiments, the user interface 30 includes one or more lights 77 (e.g., incandescent, LED, halogen, etc.) positioned on the bottom side of the user interface 30 to light the ground around the feet of the user when the snow thrower is in operation. The lights are electrically coupled to the power source 72 and may be activated by a user input device (e.g., switch, button, touch screen, etc.) or may be activated by a light sensor (e.g., turned on when the light sensor detects a particular level of darkness). The lights are desirable at night when ice may not be visible to the user to prevent slipping. The lights allow the user to directly see the user's immediate walking path behind the snow thrower 10. Conventional snow throwers including head lamps illuminate in front of the snow thrower, but may not provide sufficient lighting for the user to see between himself and the snow thrower.

Figure 8A:
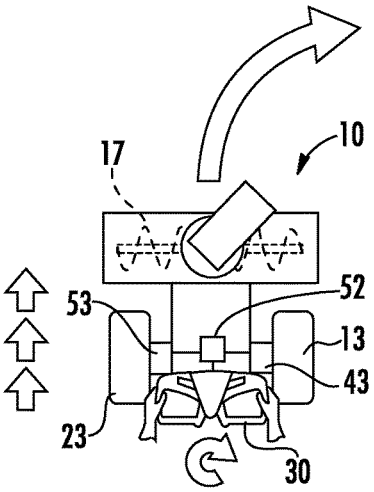
FIG. 8A is a top view of the snow thrower of FIG. 1 performing a turn at a relatively large turning radius at a relatively high speed.
Figure 8B:
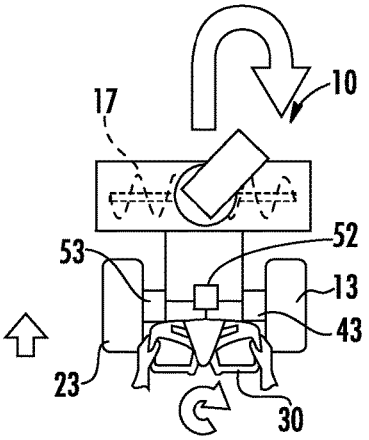
FIG. 8B is a top view of the snow thrower of FIG. 1 performing a turn at a relatively small turning radius at a relatively low speed.

Referring to FIGS. 8A and 8B, the snow thrower 10 may include a speed sensitive steering system in which the response by the wheel motors 43 and 53 to a steering input by the user through the user interface 30 varies depending on the speed of the snow thrower 10. For example, as shown in FIG. 8A, if the snow thrower 10 is moving at a relatively fast speed, a steering input may cause the snow thrower 10 to turn in the desired direction with a relatively large turning radius. Conversely, as shown in FIG. 8B, if the snow thrower 10 is moving at a relatively slow speed, a steering input may cause the snow thrower 10 to turn in the desired direction with a relatively small turning radius. In some embodiments, if the snow thrower 10 is stopped or the speed is below a threshold speed, a steering input may cause the snow thrower 10 to perform a zero-radius turn. Varying the turning radius in response to relative speed of the snow thrower 10 helps the user better control the path of the snow thrower 10 by enabling greater maneuverability at relatively slow speeds and limiting the ability of the user to turn the snow thrower 10 so quickly that the user has difficulty remaining in a normal operating position when traveling a relatively high speeds. The ECU 52 determines the speed of the snow thrower 10 based on inputs from the wheel motors 43 and 53 or speed sensors associated with the wheel motors 43 and 53. The ECU 52 also receives steering inputs (e.g., direction and magnitude of force applied by the user to the user interface 30) via the steering sensor 21. In response to the wheel speed inputs and the steering inputs, the ECU 52 provides outputs to the wheel motors 43 and 53 to execute a turn having a turning radius in accordance with both the speed of the snow thrower 10 and the user's steering input by varying the relative speed of the wheel motors 43 and 53 so that one wheel motor rotates at a higher speed than the other wheel motor to cause the snow thrower 10 to turn. When the speed of the snow thrower 10 is below a predetermined threshold value, a user input of particular force and direction via the user interface 30 (e.g., as detected by the steering sensor 21) will result in the snow thrower 10 turning at a first turning radius (FIG. 8B). When the speed of the snow thrower 10 is above the predetermined threshold value, the same user input of the same particular force and direction via the user interface 30 (e.g., as detected by the steering sensor 21) will result in the snow thrower turning at second turning radius that is greater than the first turning radius (FIG. 8A).

In some embodiments, if the user input of a particular force and direction will result in a relatively small turning radius (FIG. 8A) and the speed of the snow thrower 10 is above a predetermine threshold value, the ECU 52 provides outputs to the wheels motors 43 and 53 to slow the snow thrower 10 until the speed of the snow thrower 10 is below the predetermined threshold value. The speed of the snow thrower 10 is reduced to below the threshold value to accommodate the small radius turn so that the user does not turn so quickly that the user has difficulty remaining in a normal operating position when traveling a relatively high speeds. In some embodiments, the predetermined threshold value for snow thrower speed is determined from a look-up table correlated with the size or magnitude of the turn (e.g., turning radius) that the user is signaling should be performed by the steering input provided by the user interface 30. For each turning radius, the look-up table correlates the turning radius with a maximum allowed snow thrower speed (the predetermined threshold value) above which the desired turn will not be performed without first reducing the snow thrower speed to one at which the desired turn is allowed.

Figure 9:
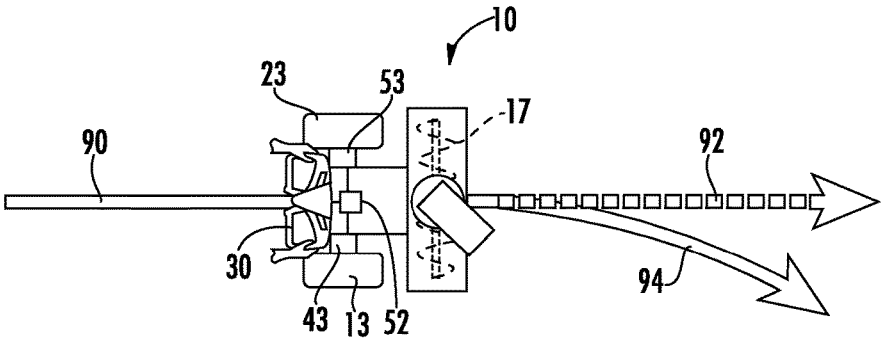
FIG. 9 is a top view of the snow thrower of FIG. 1 illustrating a straight line path correction.

Referring now to FIG. 9, the snow thrower 10 may include a direct line control steering system in which the speed of motors 43 and 53 are automatically controlled to maintain a straight path for the snow thrower 10. If the snow thrower 10 follows a relatively straight path 90 for a predetermined distance or length of time, the ECU 52 may establish a desired path 92 that is a continuation of the straight path 90. In one embodiment, a straight path 90 may be determined if the snow thrower 10 moves in a relatively straight path (e.g., >+/−5° deviation) for at least 5 seconds. If the snow thrower 10 begins to stray from the straight path 90 on a skewed path 94, the ECU 52 may control motors 43 and 53 to correct the path of the snow thrower 10 to follow the desired path 92. The path is corrected to the desired path 92 by not only steering the snow thrower 10 back onto a straight heading in the same direction as the straight path 92, but also by steering the snow thrower 10 back onto the straight path 92 itself. The path of the snow thrower 10 may be detected in any appropriate manner. For example, in one embodiment, the path of the snow thrower 10 is determined using an inertial measurement unit (e.g., a gyroscope). In one embodiment, the path of the snow thrower 10 is determined using a GPS sensor. The snow thrower 10 may deviate from the straight path 90, for example, due to an uneven surface, a tilted surface, or auger torque steer (e.g., a lateral pull due to the angular momentum of the rotating auger 17). The ECU 52 may only correct the path of the snow thrower 10 if no user input via the user interface 30 is detected. A user may therefore intentionally deviate from the straight path 90 through user input via the user interface 30 without interference from the ECU 52.

In some embodiments, the snow thrower 10 may include a traction control system in which the torque provided by the motors 43 and 53 is controlled to limit slipping of the wheels 13 and 23. Sensors, such as encoders, are provided to measure the rotational speed of the wheels 13 and 23 and/or the wheel motors 43 and 53 and provide a feedback signal to the ECU 52. If the speed of the snow thrower 10 detected by a speed sensor (e.g., the speed detected by a GPS sensor or a inertial measurement unit) is less than the speed expected in relation to the speed of the wheel motors 43 and 53, the ECU 52 may determine that the wheels 13 and 23 are slipping. The ECU may then reduce the torque provided by the wheel motors 43 and 53 to reduce wheel slip. If one of the wheels 13 and 23 begins rotating at a greater speed than the other when not intended (e.g., when turning), the ECU 52 may determine that the wheel turning faster than expected is slipping. The ECU 52 may then reduce the torque provided by the corresponding wheel motor 43 or 53 to reduce wheel slip.

In some embodiments, the ECU 52 is programmed to include a cruise control setting or function so that the speed of the snow thrower 10 is maintained at a constant speed when the input provided by the speed wheel 38 is constant even when the snow thrower 10 encounters increased loads (e.g., due to a deep snow bank), an incline, or other operational condition that might otherwise impact the speed of the snow thrower 10. As described above, wheel speed sensors, such as encoders, are provided to measure the rotational speed of the wheels 13 and 23 and/or the wheel motors 43 and 53 to provide a feedback signal to the ECU 52. In some embodiments, the expected speed of the wheels is determined from a look-up table correlating wheel speed with speed control position (e.g., the position of the speed wheel 38). When a user sets the maximum speed of the snow thrower with the maximum speed adjustor 36, a look-up table for expected speed is generated, such that for each maximum speed, a specific look-up table exists correlating a wheel speed and a speed control position. The speed of the wheels 13 and 23 is compared to the expected speed from the table. If the speed of the wheels 13 and 23 is lower than the expected speed (e.g., determined from the look-up tables), the ECU 52 provides outputs to the wheel motors 43 and 53 to increase the speed of the snow thrower 10 until the speed of the snow thrower 10 is at the expected speed.

Figure 10:
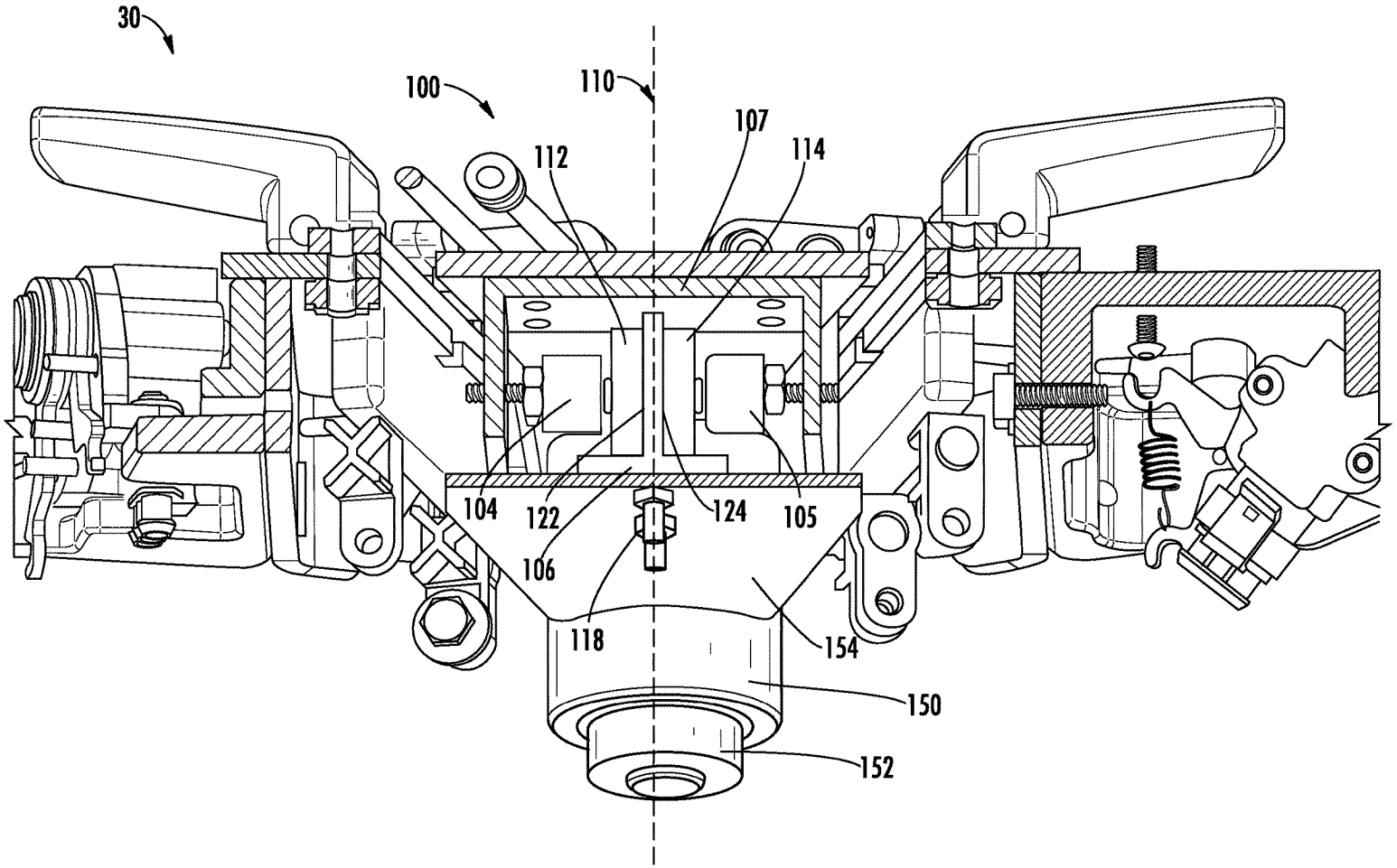
FIG. 10 is a front view of a force sensor assembly of the snow thrower of FIG. 1.
Figure 11:
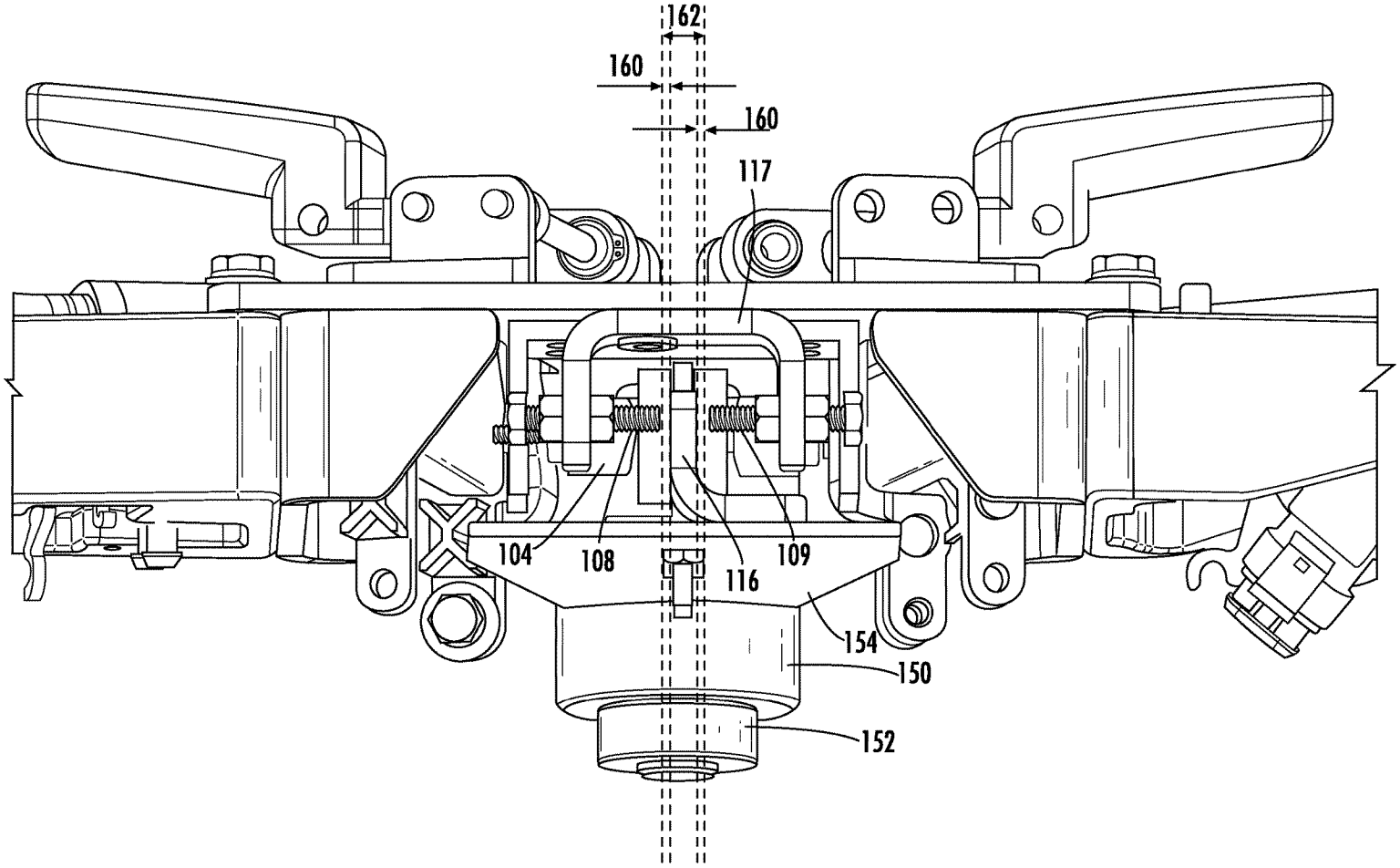
FIG. 11 is a rear view of the force sensor assembly of FIG. 10.
Figure 12:
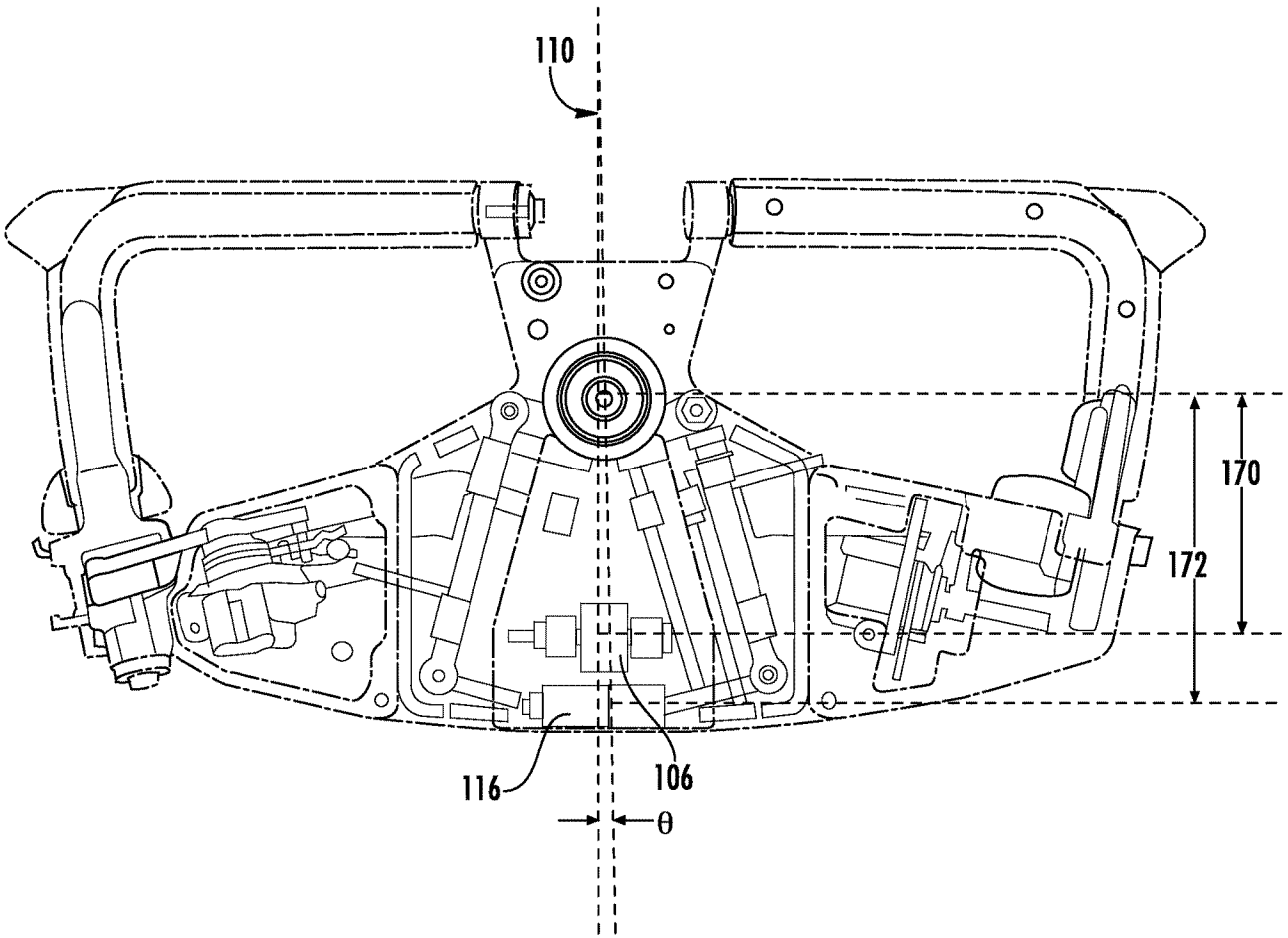
FIG. 12 is a top view of the force sensor assembly of FIG. 11.

Referring to FIGS. 10-12, the steering sensor 21 receives the user's steering input for the snow thrower 10 via the user's manipulation of the user interface 30. The steering sensor 21 provides inputs to the ECU 52 for the direction of the turn and the magnitude of the force applied by the user to the user interface 30, which is indicative of the magnitude of the desired turn to be performed by the snow thrower. The output from the ECU 52 from steering sensor 21 depends on the movement of the user interface 30 from the user. In an exemplary embodiment, if the user moves the user interface 30 to the right, the wheels (e.g., wheels 13 and 23) cause a turn to the right and if the user turns the user interface 30 to the left, the wheels cause a turn to the left. The steering sensor 21 detects the direction and force at which the user turns (pivots, rotates) the user interface 30 relative to a stationary support (e.g., angular pivot of +/−0.5°, no more than 10°) to the left and right, but, in some embodiments, does not detect forward and backward movements of the user interface 30. Thus, a user can push forward or pull backward on the user interface 30 without actuating the steering sensor 21 (e.g., causing the wheels of the snow thrower to execute an unwanted turn). Beneficially, this allows a user to "muscle" (e.g., maneuver) the snow thrower 10 forward or backward without causing the snow thrower 10 to perform an unwanted turn.

Referring to FIGS. 10-12, in some embodiments, the steering sensor 21 includes a force sensor assembly 100 for receiving the user's steering inputs for the snow thrower 10. The force sensor assembly 100 includes a left force sensor 112 and a right force sensor 114 that combine to provide inputs to the ECU 52 for the direction of the turn and the magnitude of the force applied by the user to the user interface 30, which is indicative of the magnitude of the desired turn to be performed by the snow thrower. In other embodiments, the steering sensor 21 includes a torque sensor configured to detect both the direction of the turn and the magnitude of the force or torque applied by the user to the user interface 30, which is indicative of the magnitude of the desired turn to be performed by the snow thrower. The torque sensor may include one or more strain gauges. In other embodiments, the steering sensor 21 includes a position sensor configured to detect the direction of the turn and a force sensor configured to detect the magnitude of the force applied by the user to the user interface 30, which is indicative of the magnitude of the desired turn to be performed by the snow thrower. In other embodiments, the steering sensor 21 includes more than two sensors (e.g., two force sensors and two position sensors).

The left and right force sensors 112, 114 are paired with corresponding left and right bumpers 104, 105. The bumpers 104, 105 are made from an elastic material, such as rubber such that the bumpers 104, 105 deform slightly under force. A mounting bracket 106 is positioned between the left and right force sensors 112, 114 with the left and right force sensors 112, 114 supported by and attached to left and right surfaces 122, 124 of the mounting bracket 106, respectively. As illustrated, the mounting bracket 106 is arranged in a T-shape such that the bottom surface of the mounting bracket 106 contacts the support plate 154 and the middle protrusion of the mounting bracket 106 is positioned between the force sensors 112, 114. In other embodiments, the mounting bracket 106 can be otherwise shaped. The force sensors 112, 114 may be resistive force sensors, load cells, or other appropriate force sensing devices. The bumpers 104, 105 are supported by or attached to a mounting bracket 107. As illustrated, the mounting bracket 107 is U-shaped with each bumper 104, 105 attached to a vertical portion of the bracket 107. In other, embodiments, the mounting bracket 107 can be otherwise shaped or each bumper 104, 105 can be supported by separate mounting brackets 107.

The left and right force sensors 112, 114 and bumpers 104, 105 are positioned a first distance 170 from an axis of rotation 110 of the user interface 30. The mounting bracket 107 is attached to the user interface 30 at the first distance 170 from the axis of rotation 110. The user interface 30 is attached to an movable column 150 configured to move (e.g., rotate, pivot) about the axis of rotation 110 with the movement of the user interface 30 so that movement of the user interface 30 causes similar movement of the mounting bracket 107 and the bumpers 104, 105. A fixed column 152 is positioned within the movable column 150 and is configured to remain fixed or stationary with respect to the body 12 of the snow thrower 10 (e.g., support column 20). The mounting bracket 106 is attached to the fixed column 152 so that the force sensors 112, 114 remain in a fixed position when the user interface 30 is moved. As illustrated, the movable column 150 is arranged outside of the centrally located fixed column 152. In other embodiments, the outer column is fixed and the inner column is movable.

As a user moves the user interface 30, the movable column 150 moves, thereby moving the mounting bracket 107 and the bumpers 104, 105 so that the left bumper 104 or the right bumper 105 exerts a force on the left force sensor 112 or right force sensor 114, respectively, in proportion to the amount of movement of the user interface 30. The force exerted on the left and right force sensors 112,114 varies with the amount of movement of the user interface 30. For example, if the user moves the user interface 30 hard to the left (counterclockwise about the axis of rotation 110), the force exerted on the left force sensor 112 is relatively high, resulting in a sharp turn to the left (e.g., small turning radius), and if the user moves the user interface 30 slightly to the left, the force exerted on the left force sensor 112 will be small, resulting in a relatively gentle turn to the left (e.g., large turning radius), so that steering (e.g., the radius of the turn performed by the snow thrower 10) is proportional to input force applied to the force sensors 112, 114 by the user's movement of the user interface 30. In an alternative embodiment, the force sensors 112, 114 and the mounting bracket 106 are attached to the user interface 30 and the movable column 150 and the bumpers 104, 105 and the mounting bracket 107 are attached to the fixed column 152 so that the force sensors 112, 114 move with movement of the user interface 30 and the fixed bumpers 104, 105 exert force on the sensors 112, 114 in proportion to the magnitude of movement of the sensors 112, 114.

Referring to FIGS. 11 and 12, the force sensor assembly 100 also includes a stop plate 116 and a pair of hard stops 108, 109 that limit the range of motion between the user interface 30 and the fixed column 152. The stop plate 116 is attached to the fixed column 152 by the support plate 154. The hard stops 108, 109 are attached to a mounting bracket 117 that is attached to the user interface 30 so that movement of the user interface 30 causes similar movement of the mounting bracket 117 and the hard stops 108, 109. The stop plate 116 and the hard stops 108, 109 are positioned at a distance 172 from the axis of rotation 110. The stop plate 116 includes a vertical portion positioned between the two hard stops 108, 109. As shown in FIG. 11, the stop plate 116 has a range of motion 162 between the hard stops 108, 109. As a user moves the user interface 30 in a slightly left or right direction, the stop plate 116 moves a distance 160 from the axis of rotation 110 to the hard stops 108, 109. The stop plate 116 contacts the respective hard stop 108, 109 at full-left and full-right turn positions to limit the movement of the user interface 30 about the axis of rotation 110. Contact between the stop plate 116 and the hard stops 108, 109 limits movement of the user interface 30 relative to the fixed column 152 to an angular range of motion θ between a center position and a full-left or full-right turn position.

The angular range of motion θ of the user interface 30 is relatively small. The angular range of motion θ allows the user to move (e.g., rotate, pivot) the entire user interface 30, but with much less of a range of motion than a conventional steering wheel (e.g., as found on a riding lawn mower). In some embodiments, the angular range of motion θ is between −1° and +1°. In other embodiments, the angular range of motion may be between −5° and +5°. In other embodiments, the angular range of motion may be between −10° and +10° or −15° and +15°. The relatively small angular motion θ provides haptic feedback to the user that confirms to the user that a steering input has been provided to the user interface 30 to control the direction of travel of the snow thrower 10. A lack of haptic feedback (e.g., if the user interface 30 could not move relative to the fixed column 152) can result in a steering control system in which the user feels detached or separated from the operation of the snow thrower and unsure of whether a steering input has been properly provided to the user interface 30, all of which may decrease user satisfaction with or confidence in the steering control system.

The angular range of motion θ of the user interface 30 may differ based on the application of the outdoor power equipment. In use with equipment such as riding lawn equipment and zero-turn radius equipment, the angular range of motion θ of the user interface 30 may be larger than that used with a snow thrower. In some embodiments, the angular range of motion θ is between −90° and +90°. The angular range of motion θ is limited to a particular range such that a user is not compelled to remove a hand from the user interface 30 while performing a turn, thereby improving upon a conventional steering wheel that requires a user to remove one or more hands from the steering wheel to execute turns having a small turning radius or a zero turning radius by turning the wheel in a hand-over-hand manner. Limiting the angular range of motion θ relative to that required by a conventional steering wheel thereby encourages safe use of the vehicle by allowing the user's hands to remain on the user interface 30 throughout the full range of steering inputs.

In some embodiments, the left and right force sensors 112, 114 and the bumpers 104, 105 can be positioned at different distances 170 from the axis of rotation 110 to change the amount of movement of the user interface 30 necessary to impart a particular force on the force sensors 112, 114. For example, if the sensors 112, 114 and the bumpers 104, 105 are located at a distance 170 relatively close to the axis of rotation 110, the bumpers 104, 105 will apply a particular force to the sensors 112, 114 with a relatively small movement of the user interface 30 than compared to the movement of the user interface 30 necessary to apply the same particular force to the sensors 112, 114 with the sensors 112, 114 and the bumpers 104, 105 located at a distance 170 relatively far from the axis of rotation 110. Adjusting the distance 170 thereby adjusts the steering sensitivity provided by the force sensor assembly 100. The user interface 30 may include multiple mounting locations for the mounting brackets 106 and 107 that support the sensors 112, 114 and the bumpers 104, 105. Multiple mounting locations allow the manufacturer to provide different steering sensitivities with the same user interface 30 by selecting the mounting location that corresponds with the desired steering sensitivity for a particular product.

In different embodiments, the durometer of the bumpers 104, 105 can be varied to change the steering sensitivity provided by the force sensor assembly 100. Bumpers 104, 105 having a harder durometer apply more force to the force sensors 112, 114 for a given movement of the user interface 30 than bumpers 104, 105 having a softer durometer. The harder durometer bumpers will therefore provide more sensitive steering.

Referring now to FIGS. 1-5 in general, prior to using the snow thrower 10 to clear snow, a user may adjust the user interface 30 to a desired height and tilt. The user may adjust the height of the user interface 30 by sliding the user interface 30 either in toward the body 12 or out from the body 12 on the support column 20. By sliding the user interface 30 inward or outward from the body 12, the user may adjust the snow thrower 10 for varying user heights. Similarly, the user may adjust the angle of tilt of the user interface 30 relative to the support column 20 and the body 12.

Once ready to use the snow thrower 10, a user may operate the snow thrower 10 entirely through use of the user interface 30. To start the snow thrower 10, a user may press the ignition switch 40 on the user interface 30. If the snow thrower 10 includes a removable key 41, the user may need to make sure that the key 41 is coupled to the user interface 30 prior to pressing the ignition switch 40. The user may decide that he or she does not desire to start the engine 70 prior to moving the snow thrower 10. In that case, the user may move the snow thrower 10 through use of the drive wheel input device 24 and the speed wheel 38. By depressing the drive wheel input device 24, the user may electrically engage the wheels (e.g., right wheel 13, left wheel 23) of the snow thrower 10 without starting the engine 70. Further, the user may increase the speed of the wheels using the speed wheel 38. This may include moving the snow thrower 10 in a forward or a reverse direction. In some embodiments, the user may operate the user interface 30 to move the snow thrower 10 (e.g., without engaging the engine 70) using only one hand through the use of the drive wheel input device 24 and the speed wheel 38. A user may move the snow thrower 10 using one hand, for example, when moving the snow thrower 10 into or out of storage (e.g., a shed, garage, etc.), thereby leaving the other hand free to perform other tasks (e.g., move other objects out of the way, hold a door open, etc.).

The user may then either start the engine 70 using the ignition switch 40 as stated above or the user may use the auger engagement input device 26 to simultaneously start the engine 70, increase the engine speed to engage the clutch 45 at a predetermined speed and thus, engage the auger 17. If the user depresses the auger engagement input device 26 without first starting the engine 70, the engine 70 starts, and the engine speed is increased to at least a predetermined speed (e.g., the engine speed at which the centrifugal clutch 45 is engaged and the auger 17 is active). If the engine 70 is started prior to depressing the auger engagement input device 26, the engine speed is increased at that time to engage the clutch 45 and thus start operation of the auger 17. In some embodiments, if the user releases the auger engagement input device 26 after they have already engaged the clutch 45, the auger 17 remains active until the user depresses the auger engagement input device 26 again. Once the clutch 45 is disengaged, the engine 70 may go into an idle-down mode.

When the snow thrower 10 is in operation, the user may control various features of the snow thrower 10 using the user interface 30. The user may control the angles of the deflector 18 and the neck 16 of the chute 14 using the deflector adjustor 34 and the chute rotator 28, respectively. These controls allow for varying angles of snow discharge from the chute 14. This may help in directing unwanted snow to a relatively more precise location than conventional snow throwers. The user may additionally control the wheel speed using the speed wheel 38 and may set a maximum wheel speed 62 using the maximum speed adjustor 36. By setting the maximum speed adjustor 36 to a desired maximum speed, the user may move the speed wheel 38 to its furthest position (either in a forward or a reverse direction) and not exceed that maximum wheel speed 62.

When the user has completed operation of the snow thrower 10, in some embodiments, the user may depress the auger engagement input device 26 to stop the auger 17 and the engine 70 or the user may press the ignition switch 40 to turn off the engine 70. In other embodiments, the user may need to press the ignition switch 40 to turn off the engine 70. In other embodiments, all operations of the snow thrower 10 (e.g., wheel motors 43 and 53, auger 17, engine, 70, etc.) may be configured to stop automatically if the user releases the user interface 30 with both hands. Stopping various operations of the snow thrower 10 may be accomplished by any suitable means (e.g., grounding an ignition coil, opening a switch, tripping a breaker, etc.).

In some embodiments, the snow thrower 10 includes one or more mode selection input devices (e.g., buttons, switches, touch screen, etc.) to allow the user to select a particular operating mode to be implemented by the ECU 52. In the different operating modes, the ECU 52 provides different limits or constraints on the operation of the electrical components of the snow thrower 10 (e.g., by limiting maximum motor speed, preventing operation of a particular electrical component, etc.). For example, the snow thrower 10 may include a garage mode, where the maximum speed of the snow thrower 10 is lower than in normal operation. Garage mode may be beneficial when the snow thrower 10 is being moved into or out of storage by moving the snow thrower 10 at a lower speed less likely to result in contact between the snow thrower 10 and other items in the garage. The snow thrower 10 may additionally include a transport mode, where the maximum speed of the snow thrower 10 may be faster than in normal operation mode, but with auger operation disabled. This allows the user to quickly return the snow thrower to a storage location (e.g., a garage, a trailer for transport to another job location for a snow removal service, etc.) without operating the auger. In some embodiments, a user is able to set personalized operating modes to store a particular user's preferences (e.g., steering sensitivity, maximum or minimum motor speeds, reverse steering, etc.).

The user interface 30 and related control systems have primarily been described as applied to a snow thrower. However, in other embodiments, the user interface 30 and the related control systems can be applied to other types of outdoor power equipment. Outdoor power equipment includes lawn mowers, riding tractors, snow throwers, pressure washers, tillers, log splitters, zero-turn radius mowers, walk-behind mowers, wide area walk-behind mowers, riding mowers, stand-on mowers, pavement surface preparation devices, industrial vehicles such as forklifts, utility vehicles, commercial turf equipment such as blowers, vacuums, debris loaders, overseeders, power rakes, aerators, sod cutters, brush mowers, etc.

The specific user input devices or controls needed for a particular type of outdoor power equipment can be arranged on the user interface in a manner similar to the arrangement of the controls for the snow thrower so the controls are positioned based on frequency of use and priority of user. In this way, lower priority or less frequently used controls (e.g., an incremental mowing deck height adjustment, etc.) may be positioned such that the user needs to remove a hand to adjust the control and higher priority or more frequently used controls (e.g., speed or throttle input, blade engagement/disengagement, mower deck raise and lower, a maximum speed adjustment, etc.) may be positioned such that the user does not need to remove a hand to adjust the control.

In outdoor power equipment configured for use by a seated user (e.g., a seated zero-turn lawn mower), the user interface 30 may be arranged so as to help the user maintain his seated position in the seat or other operator location of the lawn mower. For example, the user interface 30 may be movably supported to move between an open or entrance position and a closed or operational position. In the open position, the user interface 30 is located away from the seat, providing a clear path for the user's ingress and egress from the seat. After the user is positioned in the seat, the user interface 30 is moved to the closed position. In the closed position, the user interface 30 is located in front of the seat with the user located between the seat and the user interface 30. The user interface 30 is locked or otherwise secured in the closed position so that it may not unwantedly move from the closed position. In the closed position, the user interface 30 helps to keep the user in the seat during operational movement of the outdoor power equipment because the user interface 30 provides a secured rigid support platform (like a dashboard) for the user to grasp and acts as a physical barrier between the seated user and any unwanted forward movement by the user out of the seat. During operation, and particularly at high speeds, this allows the user to grasp the user interface 30 with both hands, control the speed of the unit, and steer the unit while having a secured rigid support platform that the user can support himself with to help the user remain stationary in the seat of the outdoor power equipment. In contrast, many conventional seat zero-turn lawn mowers include two separately movable hand control levers that do not provide the user with a support platform that the user can support himself with. When a user exerts a force on the conventional movable control levers, the levers must move and do not provide the user himself with support against unwanted movement. With the user interface 30 locked in the closed position, the user is able to manipulate the user interface 30 as needed to steer the unit, while at the same time applying a bracing force against the user interface 30 to help the user maintain stability in the seat and remain seated.

The movable user interface 30 may be mounted on a pivot so as to swing between the open and closed positions with little or no change in the elevation of the user interface 30. In such embodiments, the user interface 30 may be separately adjustable in the vertical direction so allow the user to vary the height of the user interface 30 when in the closed position. In other embodiments, the user interface 30 may be mounted on an elevator or other device that allows the user interface 30 to move vertically between the open and closed positions. In other embodiments, the user interface 30 is mounted on an overhead arm that allows the user to lower the user interface 30 from an overhead open position to a closed position in front of the seat.

The construction and arrangement of the apparatus, systems, and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. A snow thrower, comprising:

an auger for gathering snow;

a chute for discharging the gathered snow;

a prime mover;

a first drive wheel powered by the prime mover, wherein the first drive wheel is configured to be driven at variable speeds;

a second drive wheel powered by the prime mover, wherein the second drive wheel is configured to be driven at variable speeds;

a user interface configured to pivot within an angular range of motion relative to an axis of rotation to indicate a direction and a magnitude of a desired turn, the user interface comprising:

a left hand grip and a right hand grip;

a first plurality of input devices located near the left hand grip, configured to be operable by a user such that the user can operate the input devices without removing a left hand from the left hand grip;

a second plurality of input devices located near the right hand grip, configured to be operable by the user such that the user can operate the input devices without removing a right hand from the right hand grip;

wherein one of the first plurality and second plurality of input devices is an electronic speed input device configured to control speed and direction of the drive wheels, wherein the electronic speed input device is configured to adjust the speed of the wheels among a range of speeds;

wherein one of the first plurality and second plurality of input devices is an electronic drive wheel input device configured to selectively control the engagement of the drive wheels; and wherein one of the first plurality and second plurality of input devices is an electronic auger input device configured to selectively control the engagement of the auger;

a steering sensor configured to receive a user input indicating a direction and a magnitude of a desired turn;

an electronic control unit configured to receive a signal from the steering sensor and control operation of the first drive wheel and the second drive wheel; and wherein the electronic control unit is programmed to:

determine the direction and the magnitude of the desired turn in response to the steering sensor signal; and control the relative speeds of the first drive wheel and the second drive wheel to execute the desired turn.

2. The snow thrower of claim 1, wherein the prime mover comprises two electric motors with the first electric motor powering the first drive wheel and the second electric motor powering the second drive wheel.

3. The snow thrower of claim 1, wherein the steering sensor comprises a first force sensor, a second force sensor, a first bumper positioned near the first force sensor, and a second bumper positioned near the second force sensor, and the snow thrower further comprises:

a stop assembly including a stop plate, a first hard stop, and a second hard stop that define the angular range of motion;

wherein when the user interface is pivoted in the first direction, the stop plate and the first hard stop are configured to stop movement of the user interface in the first direction; and wherein when the user interface is pivoted in the second direction, the stop plate and the second hard stop are configured to stop movement of the user interface in the second direction.

4. The snow thrower of claim 3, wherein the angular range of motion is between −1° and +1°.

5. The snow thrower of claim 1, wherein the first bumper and the second bumper are attached to the user interface to move with the user interface and are configured to move relative to the first force sensor and the second force sensor.

6. The snow thrower of claim 1, wherein the first force sensor and the second force sensor are attached to the user interface to move with the user interface and are configured to more relative to the first bumper and the second bumper.

7. The snow thrower of claim 1, wherein the user interface further includes a light positioned on an underside of the user interface configured to light a surface below the user interface.

8. The snow thrower of claim 1, further comprising:

a speed sensor configured to detect a snow thrower speed and provide a snow thrower speed signal to the electronic control unit;

a first wheel sensor configured to measure a first rotational speed of the first driven wheel and provide a first wheel rotational speed signal to the electronic control unit; and a second wheel sensor configured to measure a second rotational speed of the second driven wheel and provide a second wheel rotational speed signal to the electronic control unit;

wherein the electronic control unit is programmed to:

determine that the first drive wheel is slipping in response to a comparison of the first wheel rotational speed signal and the snow thrower speed signal;

control operation of the first drive wheel to reduce slipping;

determine that the second drive wheel is slipping in response to a comparison of the second wheel rotational speed signal and the snow thrower speed signal; and control operation of the second drive wheel to reduce slipping.

9. The snow thrower of claim 1, further comprising:

a body;

a handle coupling the user interface to the body;

a chute motor, wherein the chute motor is configured to rotate the chute relative to the body about a vertical axis;

a deflector rotatable relative to the chute about a horizontal axis, wherein the deflector is configured to discharge snow from the chute of the snow thrower; and a deflector motor, wherein the deflector motor is configured to rotate the deflector relative to the chute about the horizontal axis;

wherein the user interface is further configured to allow the user to control operation of the chute and the deflector, wherein the user interface includes:

a chute position input device, wherein the chute position input device is configured to control operation of the chute motor;

a deflector position input device, wherein the deflector position input device is configured to control operation of the deflector motor; and a maximum speed input device, wherein the maximum speed input device is configured to set a maximum speed of the snow thrower.

10. The snow thrower of claim 1, further comprising:

an internal combustion engine; and a centrifugal clutch coupling the engine to the auger, wherein the centrifugal clutch is configured to engage at a predetermined speed of the engine to cause the engine to drive the auger.

11. Outdoor power equipment, comprising:

a prime mover;

a first drive wheel powered by the prime mover, wherein the first drive wheel is configured to be driven at variable speeds;

a second drive wheel powered by the prime mover, wherein the second drive wheel is configured to be driven at variable speeds;

a user interface configured to pivot within an angular range of motion relative to an axis of rotation to indicate a direction and a magnitude of a desired turn, the user interface including:

a left hand grip;

a right hand grip;

a first plurality of input devices located near the left hand grip, configured to be operable by a user such that the user can operate the input devices without removing a left hand from the left hand grip;

a second plurality of input devices located near the right hand grip, configured to be operable by the user such that the user can operate the input devices without removing a right hand from the right hand grip;

wherein one of the first plurality and second plurality of input devices is an electronic speed input device configured to control speed and direction of the drive wheels wherein the electronic speed input device is configured to adjust the speed of the wheels among a range of speeds;

wherein one of the first plurality and second plurality of input devices is an electronic drive wheel input device configured to selectively control the engagement of the drive wheels; and wherein one of the first plurality and second plurality of input devices is an electronic auger input device configured to selectively control the engagement of the auger;

a steering sensor configured to receive a user input indicating a direction and a magnitude of a desired turn;

an electronic control unit configured to receive a signal from the steering sensor and control operation of the first drive wheel and the second drive wheel; and wherein the electronic control unit is programmed to:

determine the direction and the magnitude of the desired turn in response to the steering sensor signal; and control the relative speeds of the first drive wheel and the second drive wheel to execute the desired turn.

12. The outdoor power equipment of claim 11, wherein the prime mover comprises two electric motors with the first electric motor powering the first drive wheel and the second electric motor powering the second drive wheel.

13. The outdoor power equipment of claim 11, wherein the steering sensor comprises a first force sensor, a second force sensor, a first bumper positioned near the first force sensor, and a second bumper positioned near the second force sensor, and the outdoor power equipment further comprises:

a stop assembly including a stop plate, a first hard stop, and a second hard stop that define the angular range of motion;

wherein when the user interface is pivoted in the first direction, the stop plate and the first hard stop are configured to stop movement of the user interface in the first direction; and wherein when the user interface is pivoted in the second direction, the stop plate and the second hard stop are configured to stop movement of the user interface in the second direction.

14. The outdoor power equipment of claim 11, wherein the angular range of motion is between −1° and +1°.

15. A snow thrower, comprising:

a first wheel;

a first wheel motor configured to drive the first wheel;

a second wheel;

a second wheel motor configured to drive the second wheel;

a user interface including a steering sensor configured to receive a user input indicating a direction and a magnitude of a desired turn; and an electronic control unit configured to:

determine a snow thrower speed in response to a first wheel speed input from the first wheel motor and a second wheel speed input from the second wheel motor;

receive the user input from the steering sensor indicating the direction and magnitude of the desired turn;

compare the magnitude of the desired turn with a maximum allowable snow thrower speed for the desired turn;

reduce the snow thrower speed to a reduced speed below the maximum allowable snow thrower speed for the desired turn; and control the first and second wheel motors to execute the desired turn.

16. The snow thrower of claim 15, wherein the steering sensor comprises a plurality of strain gauges.

17. The snow thrower of claim 15, wherein the steering sensor comprises a torque sensor.

18. The snow thrower of claim 15, wherein the steering sensor comprises a plurality of force sensors.

19. The snow thrower of claim 15, further comprising:

a body; and a handle coupling the user interface to the body;

wherein the steering sensor is configured to detect the direction and magnitude of force applied by the user to the handle via the user interface.

20. The snow thrower of claim 15, further comprising:

a chute rotatable relative to the body about a vertical axis, wherein the chute is configured to discharge snow from the snow thrower;

a chute motor, wherein the chute motor is configured to rotate the chute relative to the body about a vertical axis;

an auger, wherein the auger discharges snow from the snow thrower via the chute;

a deflector rotatable relative to the chute about a horizontal axis, wherein the deflector is configured to discharge snow from the chute of the snow thrower; and a deflector motor, wherein the deflector motor is configured to rotate the deflector relative to the chute about the horizontal axis;

wherein the user interface is further configured to allow the user to control operation of the chute, the auger, and the deflector, wherein the user interface includes:

an auger engagement input device, wherein the auger engagement input device is configured to control engagement of the auger;

a drive wheel input device, wherein the drive wheel input device is configured to control engagement of the drive wheels;

a speed input device, wherein the speed input device is configured to control speed and direction of the drive wheels;

a chute position input device, wherein the chute position input device is configured to control operation of the chute motor;

a deflector position input device, wherein the deflector position input device is configured to control operation of the deflector motor; and a maximum speed input device, wherein the maximum speed input device is configured to set a maximum speed of the snow thrower.

* * * * *